US009280077B2

(12) United States Patent
Tsunemi et al.

(10) Patent No.: US 9,280,077 B2
(45) Date of Patent: Mar. 8, 2016

(54) CHARGE CONTROL AGENT COMPOSITION FOR EXTERNAL ADDITION AND ELECTROSTATIC IMAGE DEVELOPING TONER

(71) Applicants: MORIMURA CHEMICALS LIMITED, Kanagawa (JP); SHIN-ETSU CHEMICAL CO., LTD., Tokyo (JP)

(72) Inventors: Koichi Tsunemi, Koza-gun (JP); Toshihiko Oguchi, Koza-gun (JP); Atsushi Suka, Koza-gun (JP); Takashi Iimura, Koza-gun (JP); Kazuyuki Matsumura, Annaka (JP); Muneo Kudo, Annaka (JP); Masaki Tanaka, Tokyo (JP); Yoshiteru Sakatsume, Tokyo (JP)

(73) Assignees: MORIMURA CHEMICALS LIMITED, Kanagawa (JP); SHIN-ETSU CHEMICAL CO., LTD., Tokyo (JP)

( * ) Notice: Subject to any disclaimer, the term of this patent is extended or adjusted under 35 U.S.C. 154(b) by 74 days.

(21) Appl. No.: 14/188,776

(22) Filed: Feb. 25, 2014

(65) Prior Publication Data

US 2014/0170549 A1 Jun. 19, 2014

Related U.S. Application Data

(63) Continuation of application No. PCT/JP2012/005259, filed on Aug. 22, 2012.

(30) Foreign Application Priority Data

Aug. 25, 2011 (JP) ..... 2011-183806

(51) Int. Cl.
*G03G 9/08* (2006.01)
*G03G 9/097* (2006.01)
*G03G 9/113* (2006.01)

(52) U.S. Cl.
CPC ..... *G03G 9/09733* (2013.01); *G03G 9/097* (2013.01); *G03G 9/09725* (2013.01); *G03G 9/09741* (2013.01); *G03G 9/09783* (2013.01); *G03G 9/113* (2013.01); *G03G 9/1138* (2013.01)

(58) Field of Classification Search
CPC ..... G03G 9/113; G03G 9/1138
USPC ..... 430/108.1, 111.1
See application file for complete search history.

(56) References Cited

U.S. PATENT DOCUMENTS

| | | | | |
|---|---|---|---|---|
| 5,663,027 | A * | 9/1997 | Kohri et al. | 430/106.2 |
| 6,010,811 | A * | 1/2000 | Baba et al. | 430/110.4 |
| 2003/0077536 | A1 | 4/2003 | Yamashita et al. | |
| 2006/0292482 | A1 | 12/2006 | Yamashita et al. | |

FOREIGN PATENT DOCUMENTS

| | | |
|---|---|---|
| EP | 1 239 334 | 9/2002 |
| JP | 02-073371 | 3/1990 |
| JP | 02-161471 | 6/1990 |
| JP | 04-182665 | 6/1992 |
| JP | 04-333855 | 11/1992 |
| JP | 05-127423 | 5/1993 |
| JP | 05-134457 | 5/1993 |
| JP | 05-341570 | 12/1993 |
| JP | 09-106095 | 4/1997 |
| JP | 2002-082475 | 3/2002 |
| JP | 2002-148846 | 5/2002 |
| JP | 2002-268277 | 9/2002 |
| JP | 2003-345069 | 12/2003 |
| JP | 2004-109406 | 4/2004 |
| JP | 2004-220005 | 8/2004 |
| JP | 2005-202132 | 7/2005 |
| JP | 2007-241166 A | 9/2007 |
| JP | 2009-14881 A | 1/2009 |

OTHER PUBLICATIONS

Extended European Search Report issued Mar. 20, 2015 in Patent Application No. 12825805.0.
Written Opinion issued in PCT/JP2012/005259 on Sep. 18, 2012.

* cited by examiner

*Primary Examiner* — Mark A Chapman
(74) *Attorney, Agent, or Firm* — Oblon, McClelland, Maier & Neustadt, L.L.P.

(57) ABSTRACT

There is provided an electrostatic image developing toner less likely to cause image degradation even when used for a long period, by controlling CCA particles present on surfaces of toner particles and thereby keeping an amount of tribocharge generated between the toner and a magnetic carrier or the like constant. A charge control agent composition for external addition for controlling charge amount of toner particles includes: at least two types of carrier particles different in average particle size of primary particles; and a charge control agent (CCA), and an electrostatic image developing toner is constituted of a mixture of toner particles and the aforesaid charge control agent composition for external addition.

9 Claims, No Drawings

CHARGE CONTROL AGENT COMPOSITION FOR EXTERNAL ADDITION AND ELECTROSTATIC IMAGE DEVELOPING TONER

CROSS-REFERENCE TO RELATED APPLICATIONS

This application is a continuation of prior International Application No. PCT/JP2012/005259 filed on Aug. 22, 2012, which is based upon and claims the benefit of priority from Japanese Patent Application No. 2011-183806 filed on Aug. 25, 2011; the entire contents of all of which are incorporated herein by reference.

TECHNICAL FIELD

The present invention relates to a charge control agent composition for external addition for controlling a tribocharge amount of a toner and an electrostatic image developing toner which uses the charge control agent composition for external addition to enable control tribocharge amount of the toner.

BACKGROUND ART

Conventionally, in electrophotography, charged coloring particles (hereinafter, referred to as a toner) are brought into contact with a surface of a photoconductor or a surface of a dielectric on which an electrostatic latent image is formed, and the charged toner is made to adhere on the surface of the photoconductor or the surface of the dielectric according to an electric charge amount of the electrostatic latent image, whereby a visible image is formed. This visualization operation is generally called development.

Pulverized-type toner that is most commonly used is obtained as coloring particles with an about 5 to 10 μm average particle size by a method in which a thermoplastic resin binder for toner is thermally kneaded with pigment, charge control agent (hereinafter, also referred to as CCA), wax, and so on, and the resultant is pulverized and classified.

Further, chemical toner of suspension polymerization type which has used widely is obtained by dispersing droplets with a 5 to 10 μm average particle size in which binder resin monomers, pigment, CCA, and wax are mixed and dispersed, in water to polymerize the binder resin monomers. Further, chemical toner of an emulsion polymerization aggregation type is obtained by aggregating thermoplastic resin emulsion, wax emulsion, pigment particles, and CCA particles into from 5 to 10 μm particle size.

The most important condition for obtaining a clear developed image by using these toners is that the toner is charged with the same polarity, uniformly, and with an electric charge amount optimum for a developing system. Conventionally, in order to thus uniformly charge toner, CCA is contained in the toner, and in a case of a two-component developer, it is obtained by carrying this toner to an electrostatic latent image and mixing the toner with magnetic carrier particles for charge, or in a case of a one-component developer, it is obtained by tribocharge the toner by a charging member such as a layer regulating blade disposed on a developing roller or disposed to face the developing roller.

The frictional electric charge that the toner acquires is governed by an amount of the CCA present on a surface of the toner. Therefore, attempts have been made to make a expected amount of the CCA existing on the toner surface rather than to knead it in the toner.

For example, in JP-A 2-73371 (KOKAI) and JP-A 2-161471 (KOKAI), attempts are made to make CCA existing on a surface of a toner by using a Henschel mixer, a hybridizer, or the like.

Further, in JP-A 5-127423 (KOKAI) and JP-A 2004-220005 (KOKAI), attempts are made to fix CCA fine particles on surface of toner.

Further, JP-A 5-134457 (KOKAI) discloses a method in which CCA is precipitated from a CCA solution to a toner surface and is made finer, whereby the toner surface is covered with CCA particles.

Further, in JP-A 5-341570 (KOKAI), an attempt is made to mix a toner and an aqueous dispersion of a water-dispersible small particles with a 0.01 to 0.2 μm average particle size and CCA, and by using this dispersion, form a CCA-containing small particle layer made to fixedly adhere on a toner surface. Further, JP-A 2004-109406 (KOKAI) discloses an electrostatic image developing toner in which small particles with from 0.1 to 0.8 μm average particle size are fixed on a toner surface, with CCA being dispersed in the small particles or with the CCA adhering on surfaces of the small particles.

In general, toner is consumed when it comes into contact with a surface of an electrostatic latent image to develop the electrostatic latent image. Processes after which the toner consumed in the developing step is newly supplied, is charged again by friction with an charging member, and the development are repeated. That is, during a period when the above processes of the development and the new supply steadily continue, the toner is capable of continuous development by constantly acquiring the charge.

DISCLOSURE OF THE INVENTION

Actually, however, an charge amount of toner particles gradually changes due to toner particles which are not developed, even though tribocharge, to remain in a developer, contamination of a surface of an charging member caused by its contact with the toner particles, and so on, which involves a problem that repeating the development causes image quality drop.

It can be thought that the developed image quality drop is influenced by a composition change of surfaces of the toner particles and the surface of the charging member due to the repeated developing/friction steps. Specifically, in order to constantly maintain a predetermined tribocharge amount regardless of the repeated friction and mixture, development, and supply of the toner particles, it is necessary that an amount of CCA in the surface composition of the toner particles is constantly kept at a predetermined amount.

However, even when the aforesaid conventional arts are used, it is difficult to always keep CCA amount on the toner surface constant because (1) there occurs excess and deficiency in the CCA amount on the surfaces of the toner particles due to the development and the friction/mixture process of the toner particles and the charging member in the developer, (2) the CCA on the surface of the toner particles moves to the surface of the charging member as contaminant, (3) the CCA on the surfaces of the toner particles is buried inside the toner particles, and so on. As a result, the toner charge gradually changes when the toner is used for a long period, which inevitably causes the problem of the image degradation, and these problems have not been solved yet.

Therefore, it is an object of the present invention to provide an electrostatic image developing toner whose charge generated between itself and an charging member such as a magnetic carrier can be kept in a predetermined range and which is not likely to cause image quality drop regardless of a long-term use, by keeping an amount of CCA particles present on surfaces of toner particles constant in a conventional electrostatic image developing toner.

Means for Solving the Problems

As a result of repeating studious studies with an aim to solve the problems in the methods of controlling a toner charge obtained through the conventional toner fabrication processes, the present inventors have found out that a charge control agent composition for external addition described below and an electrostatic image developing toner in which a expected ratio of the charge control agent composition for external addition is mixed cause little change in toner charge regardless of a long-term use, and have completed the present invention.

Specifically, the charge control agent composition for external addition of the present invention is a charge control agent composition for external addition for controlling toner charge, the composition including: at least two types of carrier particles different in average particle size of primary particles; and a charge control agent (CCA).

The electrostatic image developing toner of the present invention is an electrostatic image developing toner in which toner particles and a charge control agent for external addition used for controlling a tribocharge amount of the toner particles are mixed, wherein the charge control agent for external addition contains the above-described charge control agent composition for external addition of the present invention.

Effect of the Invention

The charge control agent composition for external addition of the present invention not only gives expected charge polarity and charge amount to toner particles and stably maintains these over a long period, but also functions as an external additive, and therefore, is capable of improving carriability and abrasion resistance of the toner particles.

Further, the electrostatic image developing toner of the present invention starts to be charged quickly and is capable of greatly reducing a change in a toner charge which has been a problem in conventional electrostatic image developing toners. Therefore, the electrostatic image developing toner of the present invention is capable of stabilizing an image obtained by a developing process over a long period. Incidentally, the change in the toner charge amount has conventionally occurred in such cases where an operation of mixing toner particles and a charging member such as a magnetic carrier is performed, where a developing and a replenishing process of the toner are repeated, and where a new toner is supplied into a developer.

DETAILED DESCRIPTION

The charge control agent composition for external addition of the present invention is a composition composed of a plurality of types of particles, the composition including: two types or more of carrier particles different in average particle size of primary particles; and a charge control agent (CCA), and it controls toner charge, as described above.

In general, several kinds of external additives (so called carrier particles) are added to toner in order to improve its properties. As an external additive with a small particle size (generally less than 20 nm), silica with hydrophobized surface is often used, but its main purpose is to impart flowability to the toner, and since its surface area is large, it is also sometimes used to impart charge. Further, as an external additive with a large particle size (generally 20 nm or more), silica with hydrophobized surface, resin fine particles, or the like are used, and its main purpose is to prevent the magnetic carrier particles with small particle size from being buried in the toner to change a toner property, in other words, to impart durability to the toner.

In the present invention, as the aforesaid external additives, the carrier particles and the charge control agent (CCA) are co-used, and as the carrier particles, two types or more of the carrier particles different in particle size are used, with carrier particles with a small particle size of less than 20 nm being used as at least one type and carrier particles with a large particle size of 20 nm or more being used as at least the other one type, whereby the charge control agent composition is formed. With such a composition, imparting flowability and durability to the toner and electrification control of the toner are enabled at the same time.

Among generally used external additives, some have an effect of increasing an absolute value of charge amount and some others are added in expectation of an effect of reducing a change in charge amount in an environment where a toner is used, and an example of the latter is titanium oxide (titania) or the like having hydrophobized surface. Since toner charge is caused by static charge, the charge amount changes depending on environment. Environments where toner is used generally range from low-temperature and low-humidity environment whose temperature is around 10° C. and relative humidity is around 20% to high-temperature and high-humidity environment whose temperature is around 32° C. and relative humidity is around 85% (sometimes wider than this range and sometimes narrow than this range). It is desirable that a difference in the charge amount is as small as possible in this environment range.

Further, similarly to the external additives, among CCA, some of them increase an absolute value of a toner charge and some others have an effect of reducing a difference in the charge amount due to an environmental difference. A typical example of the former is CCA of zinc complex of salicylic acid and typical example of the latter is CCA of boron complex.

That is, using CCA of boron complex having an effect of stabilizing charge with at least two types of the carrier particles of the invention makes it possible to reduce a use amount of or to do without a conventionally used titanium oxide-based external additive.

As such a charge control agent composition for external addition, two embodiments described below are preferable, for example.

First Embodiment

First, an example of a first embodiment of the present invention is a charge control agent composition for external addition including: at least two types of carrier particles different in average particle size of primary particles; and a charge control agent (CCA) deposited on surfaces of at least one type of the particles out of the carrier particles.

As the CCA used here, generally known CCA used for charge control of a toner can be used, and for example, it is made of an organic compound which has electron-accepting functional groups such as carboxylic groups, hydroxyl groups, phenolic hydroxyl groups, phosphate groups, nitro groups, halogens, or cyano groups, or electron-donating functional groups such as amino groups, alkylamino groups, or quaternary ammonium groups, or are made of organic compounds which form salt or complex with any of these functional groups. Here, a counter ion for forming the salt or the complex with the electron-accepting or electron-donating group is not limited to an organic ion, and may be a metal ion, a metal oxide ion, a halogen ion, a quaternary ammonium ion, or the like.

These CCA may be any, provided that it becomes CCA particles in a particulate form to be deposited on surfaces of later-described carrier particles. The CCA particles preferably have a 50 nm average particle size or less, and more preferably a 10 nm average particle size or less. The CCA particles also include those having a molecular size or having a size close to the molecular size. Most of those conventionally on the market as CCA particles are included in the aforesaid organic compounds, but the CCA particles of this embodiment are not limited to these. For example, resin in which 0.01 millimole % or more of an electron-donating or electron-accepting polar group is introduced into a main chain or a side chain and whose styrene-equivalent number average molecular weight is 50000 or less or resin in which the polar group of these resin molecules forms salt or a complex may be used as the CCA particles. A low-molecular weight organic compound whose molecular weight is not less than 100 nor more than 5000 and that has at least one electron-donating or electron-accepting functional group, or an organic compound forming a salt or a complex structure with these functional groups may be used as the CCA particles.

The average particle size of the CCA particles in the present specification is found by the measurement of particle size distribution by a laser diffraction/scattering method. Concretely, $D_{50}$ calculated from particle size distribution by using a laser diffraction particle size distribution analyzer Microtrac MT3300EXII type (manufactured by Nikkiso Co., Ltd, trade name), with water dispersion solvent, is defined as the average particle size.

In order to produce the CCA particles used in this embodiment, CCA particles available on the market may be reduced in particle size into CCA particles having expected average particle size by a generally known grinding method. As the grinding method here, usable are an impact grinding method in which the CCA particles are made to collide with a collision plate, an impact grinding method in which the charge control particles are made to collide with one another, a mechanical grinding method, and the like, but these methods are not restrictive, and any method of reducing the particle size may be used. Alternatively, the particles having been ground may be classified. In a generally known grinding method, since a fine powder is caught by a bag filter, the fine powder caught by the bag filter can of course be used. Further, the CCA particles used in this embodiment may be precipitated on surfaces of the carrier particles by a method in which a CCA solution obtained by once dissolving or dispersing CCA in a solvent is brought into contact with surfaces of the carrier particles and the solvent is evaporated, as will be described later. According to the method using the precipitation, producing the CCA particles with a smaller particle size and the deposition on the carrier particles are both enabled at the same time, which is preferable.

The carrier particles used in this embodiment may be those in which at least two types of carrier particles different in average particle size of primary particles (hereinafter, also referred to as primary particle size) are mixed and at least one type of the carrier particles out of these can have the CCA particles deposited on surfaces thereof. As for the particle size at this time, at least one type may be fine particles whose particle size is less than 20 nm, and preferably from 5 nm to 15 nm. Further, the particle size of at least one type is 20 nm or more, and more preferably from 50 nm to 500 nm. Particle size distribution of these carrier particles is preferably as narrow as possible, and it is especially preferable that they are spherical and hydrophobic particles.

Further, since the CCA is present on the surfaces of the carrier particles, a surface area of the whole carrier particles is also important for charge control. Specifically, it is necessary that BET specific surface area of two types or more of the carrier particles different in average particle size is 20 $m^2/g$ or more and at least one type of the carrier particles are covered by the CCA particles. Here, the specific surface area in this embodiment is calculated based on the sum of surface areas of all the used carrier particles from a relation with a mass.

Examples of materials of such carrier particles are: inorganic fine particles of a metal oxide represented by silica, titania, alumina, magnesia, zinc oxide and the like, metal carbonate or metal bicarbonate such as calcium carbonate and magnesium carbonate, metal sulfate such as calcium sulfate and barium sulfate, a metal nitride represented by silicon nitride and aluminum nitride, metal halide, silicon carbide, boron carbide, bentonite, montmorillonite, and the like; and resin fine particles of polyester, polyethylene, phenol resin, and the like. Among them, silica is especially preferable. Further, since particles produced by hydrophobizing a surface of metal oxide such as silica and titania have been in wide use as an external additive for toner and quality thereof does not have an adverse effect on a toner property, it is especially preferable that the external additive for toner having been conventionally used is applied to the carrier particles.

Further, as the carrier particles, usable are: polymer fine particles of acrylic resin, urethane resin, epoxy resin, silicone resin, melamine resin, and the like; and fine particles taken out after any of various kinds of resin emulsions in which a resin solution dissolved in a high-temperature dispersion medium is emulsified in water or an organic solvent, wax emulsion, and the like are dried. These carrier particles contain one generally called an external agent for toner. It is preferable that the surfaces of these carrier particles, especially surfaces of the metal oxide fine particles are hydrophobized by silane coupling agents such as dimethyldichlorosilane or hexamethyldisilazane and/or by silicone oil or silicone compound having alkyl groups.

Note that the average particle size of the carrier particles in the present specification is found by the measurement of particle size distribution by a laser diffraction/scattering method.

The CCA whose amount is within a range from 0.1 to 500 parts by mass per 100 parts by mass of such carrier particles is deposited on the surfaces of the carrier particles, and is used as the charge control agent composition for external addition for controlling toner charge. However, since the surface area of the carrier particles depends on their particle size, a deposition amount of the CCA per 100 parts by mass of the carrier particles is preferably from 0.1 to 50 parts by mass when the primary particle size of the carrier particles having the deposited CCA is 20 nm or more, and from 1 to 500 parts by mass when this primary particle size is less than 20 nm.

Further, an amount of the CCA added is preferably 0.01 to 50 $mg/m^2$ per unit surface area in the sum of the surface areas of all the carrier particles used. The CCA in this embodiment is present on the surfaces of the carrier particles, and therefore, when the specific surface area of the carrier particles is large, it is possible to cover the carrier particles by a larger amount of the CCA per unit mass.

The surface area of the carrier particles per unit mass can be measured by the BET method, but assuming that the carrier particles are spherical, the surface area may be calculated from true density and average particle size thereof.

The charge control agent composition for external addition of this embodiment is mixed with toner particles (colored resin particles), to form the electrostatic image developing toner. The toner particles used here are colored resin particles with an about from 4 to 10 μm in volume average particle size in which coloring fine particles are contained in thermoplastic resin particles, and contained wax or the like in order to improve thermal melting properties and fusing properties. Further, in this embodiment, the CCA is externally added and therefore need not be contained in the toner particles.

Among the colored resin particles, one called a pulverized toner is obtained by a method in which thermoplastic particles, coloring agent, wax, and so on are melted and kneaded, and thereafter the mixture is pulverized and classified into particles with expected particle size distribution, and a silica powder and so on are added thereto. Alternatively, it can also be obtained by a method in which monomers which form resin, a coloring agent, wax, and so on are dispersed in water and a dispersion is suspension-polymerized, which method is used to obtain particles called a chemical toner, a method in which fine-particle thermoplastic resin, coloring agent, and wax which are dispersed in water are aggregated, or a method in which emulsified resin particles and wax particles are aggregated with a coloring agent. The particle size of the colored resin particles in the present specification is found by a Coulter counter or a Coulter multisizer.

The charge control agent composition for external addition of this embodiment thus obtained is intended for carrying an extremely minute amount of the CCA to the surfaces of the toner particles by using the carrier particles, and at the same time intended for imparting flowability and durability to the toner particles, which role is played by a conventional external additive. This embodiment tries to control toner charge by setting an amount of the CCA that the carrier particles carry to the surfaces of 100 parts by mass of the toner particles to $1\times10^{-5}$ to 1 part by mass, preferably, $1\times10^{-4}$ to 0.5 parts by mass. At this time, the electrostatic image developing toner can be fabricated by mixing from 0.01 to 5 parts by mass of the aforesaid charge control agent composition for external addition per 100 parts by mass of the toner particles. An attempt to control toner charge by adding such an extremely small amount of CCA has not been made so far.

On the other hand, an attempt has conventionally been made to control toner charge by externally adding only carrier particles to toner particles. In this case, the carrier particles are called an external additive, and optimally selecting a toner composition makes it possible to obtain a sufficient effect on controlling the charge. When toner charge is controlled by external additive particles, it is generally known that the use of the external additive particles with a smaller particle size produces a larger effect of controlling the charge. However, when developing process is repeated by using an external additive with a small particle size, toner charge is likely to change due to a friction and the development and it is difficult to maintain a predetermined charge amount because (1) the external additive particles are buried in a toner surface due to friction with a charging member such as a magnetic carrier, (2) excess and deficiency in the external additive particles occur due to a development process, and so on.

As an external additive solving the aforesaid problem (1), an attempt to co-use external additive particles having a large particle size has also been made. However, the external additive particles with a large particle size tend to promote the abrasion of surfaces of toner particles, and there has occurred an adverse effect such as that a toner fine powder generated by the abrasion greatly changes of the toner charge.

In this embodiment, the CCA particles whose particle size is far smaller than that of the carrier particles or the CCA whose size is a molecular size controls the toner charge. How strongly such CCA particles supplied by the carrier particles work for controlling the toner charge can be understood from the fact that the CCA particles exhibit far greater charge control ability than charge control ability of the carrier particles themselves occupying a predominantly large mass. In other words, only from $1\times10^{-5}$ to 1 part by mass of the CCA particles carried per 100 parts by mass of the toner particles by the carrier particles govern an toner charge. This embodiment shows that an excellent electrostatic image developing toner is obtained by such a small amount of the CCA.

An extremely small amount of the CCA particles carried to the surfaces of the toner particles by the carrier particles is regulated to the range from $1\times10^{-5}$ to 1 part by mass per 100 parts by mass of the toner particles, but they can exhibit a sure effect of charge control when they are deposited on the surfaces of the carrier particles as particles part or most of which have a particle size that is sufficiently smaller than that of the carrier particles or that is close to a molecular size and their amount is within the range from $1\times10^{-4}$ to 0.5 parts by mass per 100 parts by mass of the toner particles.

The charge control agent composition for external addition of this embodiment is characterized in that at least two types of the carrier particles different in primary particle size are mixed, and the CCA is deposited on the surfaces of at least one type of the carrier particles out of these. By thus mixing the carrier particles different in primary particle size and covering at least one type out of these by the CCA, the effective charge control and ensuring of flowability and durability of the toner are performed at the same time.

At this time, a mass ratio of the both added particles may be such that the both particles have amounts large enough to exhibit respective functions, and when carrier particles with two types of particle sizes, that is, large particles with 20 nm primary particle size or more and small particles with a less than 20 nm primary particle size are added, the mass ratio of the carrier particles with a large particle size/the carrier particles with a small particle size is from 99/1 to 1/99, and preferably from 95/5 to 5/95. When particles with three types of particle sizes or more are mixed, a mass ratio of the particles with the largest particle size among them may be controlled to from 99 to 1, and preferably from 95 to 5.

The specific surface area of two types of the carrier particles different in primary particle size is preferably 20 $m^2/g$ or more when considered in the whole carrier particles. This is because, in order to effectively carry the CCA to the surfaces of the toner particles, the carrier particles need to have a certain degree of surface area or more, and in order to impart durability at the same time to the toner particles, it is necessary that the primary particle size is large to a certain degree, that is, the specific surface area is small.

An amount of the CCA deposited on the surface areas of two types or more of the carrier particles different in primary particle size whose specific surface area is 20 $m^2/g$ or more is selected so as to fall within a range from 0.1 to 500 parts by mass per 100 parts by mass of the carrier particles. However, depending on the particle size of the carrier particles, the surface area is different between those particles, and therefore, it is preferable that a deposition amount of the CCA per 100 parts by mass of the carrier particles is from 0.1 to 50 parts by mass when the primary particle size of the carrier particles on which the CCA is deposited is 20 nm or more, and is from 1 to 500 parts by mass when this primary particle size is less than 20 nm.

The carrier particles work in order to accurately supply such an extremely small amount of the CCA to the toner surface. A reason why such an extremely small amount of the CCA governs the toner charge is that in the charge control particles of this embodiment, the CCA which is deposited on the surfaces of the carrier particles and whose size is very close to the molecular size can be supplied to the surfaces of the toner particles. For example, assuming that the deposited CCA molecules are supplied to the surfaces of the toner particles in a state where all of them are ionized when an amount of the CCA with molecular weight of 1,000 deposited on the surfaces of the carrier particles is $1\times10^{-5}$ parts by mass, the ions can change amount of 1 part by mass of the toner particles in a negative or positive direction by about 100 μC/g. As shown in later-described examples, when the charge control agent composition for external addition of this embodiment is added to the toner particles, a value close to this theoretical charge amount has been confirmed.

A composite in which the CCA particles are deposited on the carrier particles is obtained by a method in which the CCA particles are dissolved or dispersed in a liquid such as water or organic solvent to form a CCA solution, and thereafter this CCA solution is applied on the surfaces of the carrier particles and is then dried. Further, as other methods, it can be obtained by a method of spraying an atomized CCA solution to the carrier particles in a flowing state, a method of adding a CCA solution while stirring a dispersion of the carrier particles, a method of covering the surfaces of the carrier particles by the CCA particles by a coacervation method, a method of mixing a CCA solution with the carrier particles, followed by drying and disintegration, and so on. Further, as another method, it can be obtained by depositing the CCA particles on the surfaces of the carrier particles by a mechanochemical method in which compression or a shearing stress is applied to the mixture of the CCA particles and the carrier particles during the mixing.

When the CCA particles cover all two types or more of the carrier particles different in primary particle size, after the carrier particles covered by the same CCA particles are prepared separately for the respective particle sizes, the carrier particles may be externally added to the toner particles or after the carrier particles in different size are mixed and are covered by the CCA particles at the same time, the resultant may be externally added to the toner particles. However, the carrier particles corresponding to the respective particle sizes are preferably separately covered since this facilitates the adjustment at the time of the external addition.

Further, it is also possible to dissolve the CCA particles together with resin in good solvent, followed by covering. In this case as well, there are a method of covering the carrier particles in different size separately and a method of covering them at the same time, but the former is preferable. The binder resin for the application should be soluble in the solvent and be able to disperse and to bind the CCA particles. Resins described bellow are available for the application, such as styrene acrylic resin, polyester resin for toner are polystyrene resin, vinyl chloride resin, vinylidene chloride resin, vinylidene fluoride resin, other fluorine-based resins, solvent-soluble nylon resin, butyral resin, phenoxy resin, polycarbonate resin, and the like. The solvent for the application should be good solvent for applied resin as follows, ketone-based solvent such as acetone and 2-butanone, various kinds of aliphatic hydrocarbons, aromatic hydrocarbon such as toluene and xylene, derivatives of these, various kinds of alcohols, an ester-based solvent, and cyclic ether such as THF (tetrahydrofuran).

When the CCA particles are dispersed in the resin and are deposited, an amount of the CCA added needs to be a minimum value with which the CCA can exhibit its ability. When an amount of the resin is too large for the CCA, the CCA is buried in the resin and cannot exhibit a sufficient effect, and therefore, per 100 parts by mass of the resin, from 1 to 2000 parts by mass of the CCA, preferably 10 to 1000 parts by mass thereof is contained.

The amount of the resin is much enough to cover the carrier particles and the amount depends on the particle size of the carrier particles and a large amount of the resin is required for the smaller carrier particles. When the particles to be covered are carrier particles with a 20 nm primary particle size or more, an amount of the resin is within a range of 2 to 200 parts by mass, and preferably within a range of 5 to 100 parts by mass per 100 parts by mass of the carrier particles. When the particles to be covered are carrier particles whose primary particle size is less than 20 nm, an amount of the resin is within a range of 1 to 500 parts by mass, and preferably within a range of 2 to 200 parts by mass per 100 parts by mass of the carrier particles.

0.01 to 5 parts by mass of each of these charge control agents for external addition are mixed per 100 parts by mass of the toner particles, thereby forming the electrostatic image developing toner. The ability, in particular, an electrification amount of the toner thus obtained is stabilized, and even when many high-quality electrophotographic images are printed, image quality thereof can be maintained.

An amount of CCA used in conventional use methods is from 1 to 3 parts by mass per 100 parts by mass of toner particles, while in this embodiment, an amount of the CCA is preferably within the range from $1\times10^{-5}$ to 1 part by mass per 100 parts by mass of the toner particles, and its optimum amount is from $1\times10^{-4}$ to 0.5 parts by mass. The use of the charge control agent composition for external addition of this embodiment makes it possible to control and further stabilize the charge with a far smaller amount as compared with the conventional use methods.

In the charge control agent composition for external addition of this embodiment, the CCA particles do not always uniformly cover the surfaces of the carrier particles depending on a deposition method of the CCA particles, and in some case, there occurs a state where free CCA particles not deposited on the surfaces of the carrier particles are present and are mixed with the carrier particles.

However, even when the covering is not uniform or even when the free CCA particles are present, the charge control agent composition for external addition of this embodiment fully exhibits the function of stabilizing toner charge. A reason for this is thought to be that, in the process where the charge control agent composition for external addition is supplied to the surfaces of the toner particles to be rubbed/mixed with the charging member, the free CCA particles exist on interfaces of the toner particles and the charging member become small particles by being milled by the charging member and the carrier particles, and change to particles having a size close to the molecular size.

A mechanism in which the CCA particles supplied by the carrier particles govern the charging property of the toner particles in this embodiment has not been completely clarified yet. However, the charge control mechanism can be understood as follows. First, the CCA particles carried by the carrier particles partly come into contact with the charging member such as the magnetic carrier and undergo charge exchange with the surface of the charging member to be ionized and charged. The charged CCA particles by themselves or in a state of adhering to the surfaces of the carrier particles move to the surfaces of the toner particles due to the contact with the toner particles or the like and are re-deposited on the surfaces of the toner particles to charge the toner particles. At this time, the number of the ionized CCA particles becomes close to number of CCA molecule and is predominantly larger than the number of the carrier particles. This is thought to be why the toner charge is little influenced by the carrier particles whose mass is predominantly large and the charge amount is governed by the number of the CCA particles.

According to the charge control agent composition for external addition of this embodiment thus obtained, by using this as an external additive to form an electrostatic image developing toner, it is possible to very easily supply a predetermined number of the CCA particles to the surfaces of the toner particles and to adjust the number of the CCA particles exist on the surfaces of the toner particles highly accurately, which makes it possible to form an electrostatic image developing toner given expected tribocharge. The charge control agent composition for external addition is supplied to the surfaces of the toner particles as one having the functions of both the CCA and a conventional external additive.

Further, the electrostatic image developing toner of this embodiment is an electrostatic image developing toner having a predetermined charge stably as described above. A reason why it has such property is thought that it is possible to uniformly and highly accurately supply the CCA whose size is very much close to the molecular size and which generates an extremely large charge per unit mass. At this time, when the CCA particles are deposited with the resin on the surfaces of the carrier particles, the CCA is dispersed in the resin on a molecular level, and therefore the CCA contributes as the molecules to charge, which makes it possible to stably control charge. Further, an adhesive force between the CCA particles and the carrier particles becomes stronger to improve durability, than when the CCA is directly deposited. Further, this electrostatic image developing toner starts to be charged very quickly both in a two-component developer and a one-component developer, and can be an electrostatic image developing toner which is not likely to undergo a change in its charge amount due to a frictional operation.

Further, in the electrostatic image developing toner of this embodiment, the charge control agent composition for external addition is present in a state of physically adhering on the surfaces of the toner particles because this composition and the toner particles are electrostatically sucked to each other, but are not fixed on the surfaces of the toner particles. Therefore, the charge control agent composition for external addition is characterized in being capable of easily and freely moving to surfaces of other toner particle or to the surface of the charging member such as the magnetic carrier particles when the mixture of the charge control agent composition for external addition and the toner particles is rubbed with the charging member such as the magnetic carrier particles. Therefore, the charge control agent composition for external addition of this embodiment is capable of moving the charged CCA particles to the plural toner particles, and it is thought that this degree of freedom contributes to the uniform electric charge control.

Further, such a degree of freedom is capable of contributing not only to the control of the toner but also to improvement in carriability of the toner particles and improvement in abrasion resistance of the surfaces of the toner particles similarly to a conventional external additive.

Second Embodiment

Next, as a second embodiment of the present invention, a description will be given of a charge control agent composition for external addition including at least two types of carrier particles different in average particle size of primary particles and a charge control agent (CCA). The CCA used here is basically the same as that used in the first embodiment, but is different from that used in the first embodiment in that its particle size is relatively larger and CCA particles are present independently without being deposited on the carrier particles.

The CCA used here may be any, provided that it can be externally added as the CCA particles in a particulate form having a predetermined average particle size. As the size of the CCA particles, an average particle size thereof is preferably from 100 nm to 1000 nm. The CCA particles are not used while solely added to a toner, but are used together with at least two types or more of the carrier particles different in average particle size of the primary particles. However, the CCA particles are not deposited on surfaces of the carrier particles, but the composition is formed so that two types of more of the carrier particles and the CCA particles are both independently present.

Conventionally, CCA is generally supplied in order to be kneaded (internally added) at the time when toner particles melt, and CCA particles are too large to be externally added to the toner particles. If the CCA particles with this size are used as they are, they not only cannot exhibit inherent ability of charge control but also cause poor cleaning of a photoreceptor, which becomes a cause of a defect of an image. Therefore, the direct external addition of the CCA particles to the toner has not been practically performed, even though there has been several ideas of externally adding the CCA particles to the toner. Further, in the methods of fixing the CCA or the external additive on the surface of the toner as described in the aforesaid prior arts, the CCA has a difficulty in moving to an arbitrary position of the surface of the toner, so that the effect of charge control deteriorates.

Here, the present inventors have found out that, if the conventional CCA particles are successfully turned into fine particles with a size (1000 nm average particle size or less) not causing a problem even when externally added to the toner and these CCA particles are externally added to the toner particles together with at least two types of the carrier particles different in particle size, the conventional problems are solved and it is possible to impart expected charge polarity and charge amount and stably maintain these over a long period. Note that, in this embodiment, even after turned into the fine particles, the CCA particles are used as CCA particles whose size is about equal to or larger than the size of the carrier particles having a large particle size.

As a method of pulverizing the CCA particles to 1000 nm or less, generally known mechanical pulverizing, impact pulverizing, or the like can be employed. Most of those available on the market as CCA particles can be pulverized to 1000 nm or less, but the CCA particles of this embodiment are not limited to these.

The carrier particles used here are those in which at least two types of the carrier particles different in average particle size of the primary particles (hereinafter, also referred to as the primary particle size) are mixed, as in the first embodiment. Here, when two types of the carrier particles different in average particle size are used, the carrier particles with the small particle size may be fine particles whose average particle size is less than 20 nm, preferably from 5 nm to 15 nm. Further, the carrier particles having the large particle size preferably has an average particle size of 20 nm or more, and more preferably from 50 to 500 nm. Particle size distribution of these carrier particles is preferably as narrow as possible and especially preferably, they are spherical hydrophobic particles. As a material of the carrier particles used here, those described in the first embodiment are usable.

The primary particle size of the carrier particles with the large particle size is preferably 20% or less, and more preferably 5 to 15% of the average particle size of the CCA particles. When the carrier particles having the large particle size are too large, the CCA is prevented from sufficiently coming into contact with a magnetic carrier and a toner, and when they are too small, they do not have an effect in mixing the CCA with the toner and the magnetic carrier.

Further, as for the carrier particles having the large particle size, a BET specific surface area is desirably 150 $m^2/g$ or less, and the particle size distribution is preferably as narrow as possible, and especially preferably, they are spherical hydrophobic particles. Note that the BET specific surface area is more preferably not more than 80 $m^2/g$ nor less than 10 $m^2/g$.

Since such carrier particles having the large average particle size are low in capability of imparting flowability to toner particles, the carrier particles with the small particle size are added at the same time. A BET specific surface area of the primary particles of the carrier particles having the small particle size is desirably 120 $m^2/g$ or more, and their particle size distribution is preferably as narrow as possible, and especially preferably, they are spherical hydrophobic particles. Note that the BET specific surface area of the carrier particles having the small particle size is generally 800 $m^2/g$ or less, for instance, and is preferably 500 $m^2/g$ or less.

The charge control agent composition for external addition of this embodiment is mixed with the toner particles (colored resin fine particles) to form an electrostatic image developing toner, as in the first embodiment. Further, the usable toner particles are also the same as those previously described.

In this embodiment, from 0.01 to 5 parts by mass of the carrier particles having the large particle size, from 0.1 to 5 parts by mass of the carrier particles having the small particle size, and from 0.01 to 5 parts by mass of the CCA particles are added per 100 parts by mass of the toner particles. An amount of the CCA particles is preferably 5 to 100 parts by mass per 100 parts by mass of the carrier particles having the large particle size. Since the carrier particles having the large particle size are mainly intended to impart durability to the toner, the effect is obtained if 0.01 parts by mass or more thereof are added to the toner, but the addition of parts by mass or more results in the saturation of the effect, and there is no meaning in adding them more. Since the carrier particles having the small particle size are added for the purpose of imparting flowability to the toner and adjusting charge amount, they exhibit the effect when their addition amount is 0.1 parts by mass or more, but the addition of 5 parts by mass of the carrier particles having the small particle size also results in the saturation of the effect, or when gaps between the toner particles are filled with the carrier particles having the small particle size, flowability of the toner sometimes deteriorates on the contrary.

It has conventionally been known to control charge of a toner by externally adding only carrier particles as an external additive to toner particles. At this time, a plurality of types of carrier particles different in particle size, type, or the like are often used as the external additive, and optimally selecting the composition of the external additive makes it possible to impart a sufficient effect of charge control to the toner particles. When the toner charge amount is controlled by the carrier particles, it is known that the effect of charge control is generally larger as carrier particles having a smaller particle size are used. However, when a development operation is repeated by using the carrier particles having the small particle size, an charge amount of the toner particles is liable to change due to a mixture operation and a development process in a developer and it is difficult to maintain a constant charge amount in an assumed environment, that is, from high temperature and high humidity (around 32° C. and 80% RH) to low temperature and low humidity (around 10° C. and 20% RH), because (1) the carrier particles are buried in a surface of the toner due to friction with a charging member such as a magnetic carrier, (2) there occurs excess and deficiency in the carrier particles due to a development process, and so on.

As carrier particles solving the aforesaid problem (1), an attempt to co-use carrier particles having large particle size has been made. However, the carrier particles having the large particle size tend to promote abrasion of the surface of the toner, though rarely buried in the toner, and in maintaining charge amount, an adverse effect occurs, such as that toner fine powder generated by the abrasion greatly changes the toner charge amount.

In this embodiment, the CCA particles whose particle size is about equal to or larger than that of the co-used carrier particles having the large particle size control the toner charge. How strongly the CCA particles act on the control of the charge amount of the toner particles is shown in the examples. That is, this can be understood from the fact that the CCA particles exhibit larger charge control ability than the carrier particles occupying a predominantly large mass. This embodiment was made based on the findings that such a minute amount of the CCA makes it possible to obtain an excellent electrostatic image developing toner.

The CCA particles present on the surfaces of the toner particles, immediately after externally added, partly or mostly have a particle size larger than or about equal to that of the carrier particles with the large particle size which are added separately. The CCA particles are made finer by coming into contact with the toner particles, the carrier particles, the magnetic carrier, and so on due to mixture and stirring, and they partly are deposited as particles whose size is close to that of a molecule on the surfaces of the toner particles. When an amount of the CCA particles is within the range of from 0.01 to 5 parts by mass per 100 parts by mass of the toner particles, a sure effect of charge control can be exhibited.

Further, the amount of the CCA particles of this embodiment is selected so as to fall within the range from 5 to 100 parts by mass per 100 parts by mass of the carrier particles having the large particle size as described above. The carrier particles having the large particle size work for supplying the CCA. A possible reason why the charge amount of the toner is governed by a small amount of the CCA is that the CCA particles of this embodiment become CCA particles whose particle size is further reduced to the size close to the molecular size at the time of the external addition or at the time of the mixture with the magnetic carrier, and the CCA particles made finer (hereinafter, also referred to as fine CCA particles) can be supplied to the toner surface by the carrier particles having the large particle size. As shown in the later-described examples, when the charge control agent composition for external addition of this embodiment is added to the toner particles, a value close to this theoretical charge amount has been confirmed.

In order to produce the CCA particles used in this embodiment, CCA particles available on the market may be reduced in particle size by a generally known pulverizing method, thereby producing CCA particles having a expected average particle size. As the pulverizing method here, usable are an impact pulverizing method in which the CCA particles are made to collide with a collision plate at high speed, an impact pulverizing method in which the charge control particles are made to collide with one another, a mechanical pulverizing method, and the like, but these are not restrictive, and any method of making particles finer may be used. Further, the particles having been ground may be classified. In a generally known pulverizing method, since a fine powder is caught by a bag filter, the fine powder caught by the bag filter can of course be used.

From 0.01 to 5 parts by mass of the CCA particles thus having from 100 to 1000 nm average particle size are mixed per 100 parts by mass of the toner particles, thereby forming the electrostatic image developing toner. The performance, in particular, charge amount of the toner thus obtained is stabilized, and even when many high-quality electrophotographic images are printed, image quality thereof can be maintained.

In conventional use methods, an amount of CCA contained in a toner is from 1 to 8 parts by mass per 100 parts by mass of toner particles, while in the charge control agent composition for external addition of this embodiment, an amount of the CCA is preferably within the range from 0.01 to 5 parts by mass per 100 parts by mass of the toner particles, and its optimum amount is from 0.1 to 2 parts by mass. That is, it is possible to contribute to charge with a small amount compared with the conventional use methods.

When the toner particles, the carrier particles, and the CCA particles are mixed, depending on a mixing process, it is possible to make the CCA particles still finer by the mixing process to enhance the effect. The optimum mixing process differs depending on the CCA used, and in some case, a method of supplying the toner particles, the carrier particles, and the CCA particles at the same time to mix them is effective, in another case, a method of mixing the toner particles and the carrier particles in advance and then adding the CCA particles to mix them is effective, and in still another case, a method of mixing the toner particles and the CCA particles and thereafter adding the carrier particles to mix them is effective. Further, there may be a case where the mixing timing of the carrier particles is varied depending on each average particle size thereof, and the optimum mixing condition thereof is diversified. Generally, it is possible to obtain a sufficient effect by mixing the toner particles, all the carrier particles, and the CCA particles at the same time, but it is also effective to mix the toner particles and the CCA particles and thereafter mix the carrier particles having the large particle size and the carrier particles having the small particles in the order mentioned. This is because the carrier particles having the small particle size has a high effect of imparting flowability to the toner particles and are likely to be buried in the toner surface, and therefore the CCA particles and the carrier particles having the large particle size are sufficiently mixed before flowability is imparted, and thereafter the carrier particles having the small particles size are mixed, thereby enabling the functions of the respective components to be exhibited sufficiently and effectively.

In order for the CCA particles of this embodiment to sufficiently exhibit the function thereof, it is important that the CCA particles continue to be present on the surfaces of the toner particles, and in a process of being rubbed/mixed with the charging member such as the magnetic carrier, free CCA particles present on interfaces between the toner particles and the charging member are milled by the charging member and the carrier particles into small particles, and sometimes turned into fine particles whose size is close to the molecular size, so that a high function is maintained.

A mechanism in which the CCA particles in this embodiment govern the charge of the toner particles has not been completely clarified yet. However, the charge control mechanism can be understood as follows. First, the CCA particles partly come into contact with the charging member such as the magnetic carrier as described above, and the fine CCA particles generated at this time undergo charge exchange with the surface of the charging member to be ionized and charged. The charged fine CCA particles by themselves or in a state of adhering to the surfaces of the carrier particles move to the surfaces of the toner particles due to the contact with the toner particles or the like and are re-deposited on the surfaces of the toner particles to charge the toner particles. At this time, the number of the ionized CCA particles is predominantly larger than the number of the carrier particles. This is thought to be why the charge amount of the toner particles is little influenced by the carrier particles even when the added carrier particles are larger in total mass, and the charge amount is governed by the number of the CCA particles.

According to the charge control agent composition for external addition of this embodiment thus obtained, by adding this to form the electrostatic image developing toner, it is possible to very easily supply a predetermined number of the CCA particles to the surfaces of the toner particles and to adjust the number of the CCA particles present on the surfaces of the toner particles with considerably high accuracy, which makes it possible to produce the electrostatic image developing toner given a expected charge amount.

Further, the electrostatic image developing toner of this embodiment can be an electrostatic image developing toner having a stable and predetermined charge amount since it is possible to uniformly and highly accurately supply the fine CCA particles generating a large charge amount per unit mass to the surfaces of the toner particles. At this time, this electrostatic image developing toner starts to be charged very quickly both in a two-component developer and a one-component developer, and can be an electrostatic image developing toner which is not likely to undergo a change in its charge amount due to a frictional operation and an environmental change. This charge control agent composition for external addition is supplied to the surfaces of the toner particles as one having the functions of both the CCA and the conventional external additive.

Further, in the electrostatic image developing toner of this embodiment, the fine CCA particles are present in a state of physically adhering on the surfaces of the toner particles because these fine CCA particles and the toner particles are electrostatically sucked to each other, but are not fixed on the surfaces of the toner particles. Therefore, the CCA particles are characterized in being capable of easily and freely moving to surfaces of other toner particle or to the surface of the charging member such as the magnetic carrier when the mixture of the CCA particles and the toner particles is rubbed with the charging member such as the magnetic carrier. Therefore, the CCA particles of this embodiment are capable of moving to the plural toner particles, and it is thought that this degree of freedom contributes to the uniform charge control.

Further, such a degree of freedom is capable of contributing not only to the control of the toner charge but also to improvement in carriability of the toner particles and improvement in abrasion resistance of the surfaces of the toner particles similarly to a conventional external additive.

As for the charge of the toner particles controlled by the carrier particles and the CCA particles externally added by the method of this embodiment, a permissible range of their addition amount for obtaining a predetermined charge amount is wide, and an influence by the addition of another external additive is negligible. An example of the other external additive here is hydrophobic silica with a small particle size which can give a high charge amount to the toner particles when added to the toner particles solely. That is, this silica with the small particle size, even when added at the same time with the aforesaid CCA particles, does not have an influence large enough to greatly change charge property of the toner particles since the charge amount of the toner particles is governed by the CCA particles.

Further, it has been found out that, when a two-component developer is fabricated by using the charge control agent composition for external addition of this embodiment, a change in charge amount of obtained toner in relation to the time for mixture with the magnetic carrier is small.

Further, since the charge of the toner particles is a phenomenon in which electrostatic charge is involved, it is actually impossible to keep the charge amount of the toner constant in a range from a high temperature and high humidity (around 32° C. 80% RH) to low temperature and low humidity (around 10° C. 20% RH), but in this embodiment, it is possible to make a difference thereof small.

EXAMPLES

Hereinafter, the present invention will be described with reference to examples, but the present invention is not limited to these examples. First, examples corresponding to the first embodiment (examples 1 to 10) and comparative examples (comparative examples 1 to 5) will be described.

Example 1

400 g of silica with 12 nm of primary particles size and with 140 $m^2/g$ in BET specific surface area was hydrophobized by HMDS (hexamethyldisilazane) was fed into a kneader and 100 g of THF (tetrahydrofuran) was added to be mixed. Next, while the mixture was kneaded, negative chargeable type CCA1 (manufactured by Orient Chemical Industry Co., Ltd., trade name: BONTRON E-304, a zinc complex of tertiary-butylsalicylic acid) with average particle size of 8 μm was fed and the CCA1 was completely dissolved in the THF in the system. The mixture was kneaded until uniform mixture was obtained. Thereafter, THF was evaporated and the mixture was sufficiently dried, then CCA1 was precipitated to surface of the silica, whereby charge control fine particles (EA-CCA1) in which the CCA1 was deposited was obtained. Due to the drying, the EA-CCA1 was aggregated, but could be disintegrated by pulverization and classification by an IDS-2 pulverizer and a DSX-2 classifier manufactured by Nippon Pneumatic Mfg. Co., Ltd.

At this time, feed amount of the negative chargeable-type CCA1 was set to 40 g and 200 g, and respective samples were obtained. Since the contents of the CCA1 per 100 parts by mass of carrier particles are 10 parts by mass and 50 parts by mass respectively, these charge control fine particles will be called [EA-CCA1-10] and [EA-CCA1-50] respectively.

Spherical silica with 110 nm of primary particle size and with 28 $m^2/g$ in BET specific surface area was hydrophobized by HMDS (hexamethyldisilazane) was further added to each of these EA-CCA1, whereby the charge control agent compositions for external addition of the present invention were manufactured, in which the sum of surface areas of a 10 mg mixture of these were 0.4 $m^2$, 0.7 $m^2$, and 1.1 $m^2$ (corresponding to 40 $m^2/g$, 70 $m^2/g$, and 110 $m^2/g$ specific surface areas respectively).

Regarding the obtained charge control agent compositions for external addition, those in which [EA-CCA1-10] was used and the sum of the surface areas of the carrier particles was 0.4 $m^2$, 0.7 $m^2$, and 1.1 $m^2$ were named examples 1-1, 1-2, 1-3 respectively in the order mentioned, and those in which [EA-CCA1-50] was used and the sum of the surface areas of the carrier particles was 0.4 $m^2$, 0.7 $m^2$, and 1.1 $m^2$ were named examples 1-4, 1-5, and 1-6 respectively in the order mentioned. At this time, a relation between the specific surface area of the carrier particles and an amount of the CCA (an amount of the CCA per unit surface area in the sum of the surface areas of the carrier particles) was 0.255 $mg/m^2$ in the example 1-1, 0.543 $mg/m^2$ in the example 1-2, 0.666 $mg/m^2$ in the example 1-3, 1.275 $mg/m^2$ in the example 1-4, 2.715 $mg/m^2$ in the example 1-5, and 3.33 $mg/m^2$ in the example 1-6.

Example 2

400 g of silica whose primary particles had 12 nm in average particle size and whose surface with 140 $m^2/g$ in BET specific surface area was hydrophobized by HMDS (hexamethyldisilazane) was fed into a kneader and 100 g of THF (tetrahydrofuran) was added to be mixed. Next, while the mixture was kneaded, negative chargeable-type CCA2 (manufactured by Japan Carlit Co., Ltd., trade name: LR-147, a boron complex) with average particle size of 8 μm was fed and the CCA2 was completely dissolved in the THF in the system. The mixture was kneaded until uniform mixture was obtained. Thereafter, THF was evaporated and mixture was sufficiently dried. Then CCA2 was precipitated to surface of the silica, whereby charge control fine particles (EA-CCA2) in which the CCA2 was deposited was obtained. Due to the drying, the EA-CCA2 was aggregated, but could be disintegrated by pulverization and classification by an IDS-2 pulverizer and a DSX-2 classifier manufactured by Nippon Pneumatic Mfg. Co., Ltd.

At this time, feed amount of the negative chargeable-type CCA2 was set to 4 g and 20 g and respective samples were obtained. Since the contents of the CCA2 per 100 parts by mass of carrier particles are 1 part by mass and 5 parts by mass respectively, these charge control fine particles will be called [EA-CCA2-1] and [EA-CCA2-5] respectively.

Spherical silica with 110 nm of primary particle size and surface with 28 $m^2/g$ in BET specific surface area was hydrophobized by HMDS (hexamethyldisilazane) was further added to each of these EA-CCA2, whereby the charge control agent compositions for external addition of the present invention were manufactured, in which the sum of the surface areas of a 10 mg mixture of these were 0.4 $m^2$, 0.7 $m^2$, and 1.1 $m^2$ (corresponding to 40 $m^2/g$, 70 $m^2/g$, and 110 $m^2/g$ specific surface areas respectively).

Regarding the obtained charge control agent compositions for external addition, those in which [EA-CCA2-1] was used and the sum of the surface areas of the carrier particles was 0.4 $m^2$, 0.7 $m^2$, and 1.1 $m^2$ were named examples 2-1, 2-2, and 2-3 respectively in the order mentioned, and those in which [EA-CCA2-5] was used and the sum of the surface areas of the carrier particles was 0.4 $m^2$, 0.7 $m^2$, and 1.1 $m^2$ were named examples 2-4, 2-5, and 2-6 respectively in the order mentioned.

Example 3

THF (tetrahydrofuran) was fed into a kneader and while stirring, silica whose primary particles had 12 nm in average particle size and whose specific surface area with 140 $m^2/g$ in BET method was hydrophobized by HMDS (hexamethyldisilazane) was added, followed by mixing. Next, while this mixture was kneaded, 1 mass % styrene acrylic resin for toner binder solution in THF was dropped and mixed. Further, the negative chargeable-type CCA1 used in the example 1 was fed and the CCA1 was completely dissolved in the THF in the system, followed by further kneading for the purpose of uniformity. Thereafter, the THF was evaporated and the mixture was completely dried, whereby charge control fine particles (EA-CCA3) in which the CCA1 was deposited together with the styrene acrylic resin on a surface of the silica were obtained. Due to the drying, the EA-CCA3 was aggregated, but could be disintegrated by pulverization and classification by an IDS-2 pulverizer and a DSX-2 classifier manufactured by Nippon Pneumatic Mfg. Co., Ltd. Since a ratio of the carrier particles, the styrene acrylate resin, and the CCA1 as components mixed at this time was set to 100/10/10 (parts by mass) and 100/10/50 (parts by mass), these charge control fine particles were named [EA-CCA3-10] and [EA-CCA3-50] respectively.

Spherical silica whose primary particle size was 110 nm and whose surface with 28 $m^2/g$ in BET specific surface area was hydrophobized by HMDS (hexamethyldisilazane) was further added to each of these EA-CCA3, whereby the charge control agent compositions for external addition of the present invention were manufactured, in which the sum of surface areas of 10 mg mixture of these were 0.4 $m^2$, 0.7 $m^2$, and 1.1 $m^2$ (corresponding to 40 $m^2/g$, 70 $m^2/g$, and 110 $m^2/g$ specific surface areas respectively).

Regarding the obtained charge control agent compositions for external addition, those in which [EA-CCA3-10] was used and the sum of the surface areas of the carrier particles was 0.4 $m^2$, 0.7 $m^2$, and 1.1 $m^2$ were named examples 3-1, 3-2, and 3-3 respectively in the order mentioned, and those in which [EA-CCA3-50] was used and the sum of the surface areas of the carrier particles was 0.4 $m^2$, 0.7 $m^2$, and 1.1 $m^2$ were named examples 3-4, 3-5, and 3-6 respectively in the order mentioned.

Example 4

THF (tetrahydrofuran) was fed into a kneader and while stirring, silica whose primary particles had 12 nm average particle size and whose surface with 140 $m^2/g$ BET specific surface area was hydrophobized by HMDS (hexamethyldisilazane) was added, followed by mixing. Next, while this mixture was being kneaded, 1 mass % styrene acrylic resin of THF solution used for a toner was dropped and mixed. Further, the negative chargeable-type CCA2 used in the example 2 was fed and the CCA2 was completely dissolved in the THF present in the system, followed by further kneading for the purpose of uniformity. Thereafter, the THF was evaporated and the mixture was sufficiently dried, whereby charge control fine particles (EA-CCA4) in which the CCA2 was deposited together with the styrene acrylic resin on a surface of the silica were obtained. Due to the drying, the EA-CCA4 was aggregated, but could be disintegrated by pulverizing and classification by an IDS-2 pulverizer and a DSX-2 classifier manufactured by Nippon Pneumatic Mfg. Co., Ltd. Since a ratio of the carrier particles, the styrene acrylate resin, and the CCA2 as components mixed at this time was set to 100/10/1 (parts by mass) and 100/10/5 (parts by mass), these charge control fine particles were named [EA-CCA4-1] and [EA-CCA4-5] respectively.

Spherical silica whose primary particle size was 110 nm and whose surface with 28 $m^2/g$ in BET specific surface area was hydrophobized by HMDS (hexamethyldisilazane) was further added to each of these EA-CCA4, whereby the charge control agent compositions for external addition of the present invention were manufactured, in which the sum of surface areas of 10 mg mixture of these were 0.4 $m^2$, 0.7 $m^2$, and 1.1 $m^2$ (corresponding to 40 $m^2/g$, 70 $m^2/g$, and 110 $m^2/g$ specific surface areas respectively).

Regarding the obtained charge control agent compositions for external addition, those in which [EA-CCA4-1] was used and the sum of the surface areas of the carrier particles was 0.4 $m^2$, 0.7 $m^2$, and 1.1 $m^2$ were named examples 4-1, 4-2, and 4-3 respectively in the order mentioned, and those in which [EA-CCA4-5] was use and the sum of the surface areas of the carrier particles was 0.4 $m^2$, 0.7 $m^2$, and 1.1 $m^2$ were named examples 4-4, 4-5, and 4-6 respectively in the order mentioned.

Example 5

400 g of silica whose primary particles had 110 nm average particle size and whose surface with 28 $m^2/g$ in BET specific surface area was hydrophobized by HMDS (hexamethyldisilazane) was fed into a kneader and while stirring, 100 g of THF (tetrahydrofuran) was added to be mixed. Next, while this mixture was being kneaded, the negative chargeable-type CCA1 (zinc complex) was fed and the CCA1 was completely dissolved in the THF present in the system, followed by further kneading for the purpose of uniformity. Thereafter, the THF was evaporated and sufficiently dried, and the CCA1 was precipitated to a surface of the silica, whereby charge control fine particles (EA-CCA5) in which the CCA1 was deposited was obtained. Due to the drying, the EA-CCA5 was aggregated, but could be disintegrated by pulverizing and classification by an IDS-2 pulverizer and a DSX-2 classifier manufactured by Nippon Pneumatic Mfg. Co., Ltd.

At this time, a supply amount of the negative chargeable-type CCA1 was set to 40 g and 200 g and respective samples were obtained. Since the contents of the CCA1 per 100 parts by mass of carrier particles are 10 parts by mass and 50 parts by mass respectively, these charge control fine particles will be called [EA-CCA5-10] and [EA-CCA5-50] respectively.

Spherical silica whose primary particle size was 12 nm and whose surface with 140 $m^2/g$ in BET specific surface area was hydrophobized by HMDS (hexamethyldisilazane) was further added to each of these EA-CCA5, whereby the charge control agent compositions for external addition of the present invention were manufactured, in which the sum of surface areas of a 10 mg mixture of these were 0.35 $m^2$, 0.56 $m^2$, and 0.84 $m^2$ (corresponding to 35 $m^2/g$, 56 $m^2/g$, and 84 $m^2/g$ specific surface areas respectively).

Regarding the obtained charge control agent compositions for external addition, those in which [EA-CCA5-10] was used and the sum of the surface areas of the carrier particles was 0.35 $m^2$, 0.56 $m^2$, and 0.84 $m^2$ were named examples 5-1, 5-2, and 5-3 respectively in the order mentioned, and those in which [EA-CCA1-50] was used and the sum of the surface areas of the carrier particles was 0.35 $m^2$, 0.56 $m^2$, and 0.84 $m^2$ were named examples 5-4, 5-5, and 5-6 respectively in the order mentioned.

Example 6

400 g of silica whose primary particles had 110 nm average particle size and whose surface with 28 $m^2/g$ in BET specific surface area was hydrophobized by HMDS (hexamethyldisilazane) was fed into a kneader and while stirring, 100 g of THF (tetrahydrofuran) was added to be mixed. Next, while this mixture was being kneaded, the negative chargeable-type CCA2 (boron complex) was fed and the CCA2 was completely dissolved in the THF present in the system, followed by further kneading for the purpose of uniformity. Thereafter, the THF was evaporated and sufficiently dried. The CCA2 was precipitated to a surface of the silica, whereby charge control fine particles (EA-CCA6) in which the CCA2 was deposited was obtained. Due to the drying, the EA-CCA6 was aggregated, but could be disintegrated by pulverizing and classification by an IDS-2 pulverizer and a DSX-2 classifier manufactured by Nippon Pneumatic Mfg. Co., Ltd.

At this time, a feed amount of the negative chargeable-type CCA2 was set to 4 g and 20 g and respective samples were obtained. Since the contents of the CCA2 per 100 parts by mass of carrier particles are 1 part by mass and 5 parts by mass respectively, these charge control fine particles will be called [EA-CCA6-1] and [EA-CCA6-5] respectively.

Spherical silica whose primary particle size was 12 nm and whose surface with 140 $m^2/g$ in BET specific surface area was hydrophobized by HMDS (hexamethyldisilazane) was further added to each of these EA-CCA6, whereby the charge control agent compositions for external addition of the present invention were manufactured, in which the sum of surface areas of a 10 mg mixture of these were 0.35 $m^2$, 0.56 $m^2$, and 0.84 $m^2$ (corresponding to 35 $m^2/g$, 56 $m^2/g$, and 84 $m^2/g$ of specific surface areas respectively).

Regarding the obtained charge control agent compositions for external addition, those in which [EA-CCA6-1] was used and the sum of the surface areas of the carrier particles was 0.35 $m^2$, 0.56 $m^2$, and 0.84 $m^2$ were named examples 6-1, 6-2, and 6-3 respectively in the order mentioned, and those in which [EA-CCA6-5] was used and the sum of the surface areas of the carrier particles was 0.35 $m^2$, 0.56 $m^2$, and 0.84 $m^2$ were named examples 6-4, 6-5, and 6-6 respectively in the order mentioned.

Example 7

400 g of silica whose primary particles had 12 nm average particle size and whose surface with 140 $m^2/g$ in BET specific surface area was hydrophobized by HMDS (hexamethyldisilazane) was fed into a kneader and while stirring, 100 g THF (tetrahydrofuran) was added to be mixed. Next, while this mixture was being kneaded, a positive chargeable-type CCA7 (manufactured by Chuo Synthetic Chemical CO., Ltd., trade name: CHUO CCA3, a nigrosine-based dye) with 5 μm in average particle size was fed and the CCA7 was completely dissolved in the THF present in the system, followed by further kneading for the purpose of uniformity. Thereafter, the THF was evaporated and sufficiently dried and the CCA7 was precipitated to a surface of the silica, whereby charge control fine particles (EA-CCA7) in which the CCA7 was deposited was obtained. Due to the drying, the EA-CCA7 was aggregated, but could be disintegrated by pulverizing and classification by an IDS-2 pulverizer and a DSX-2 classifier manufactured by Nippon Pneumatic Mfg. Co., Ltd.

At this time, feed amount of the positive chargeable-type CCA7 was set to 40 g and 200 g and respective samples were obtained. Since the contents of the CCA7 per 100 parts by mass of carrier particles are 10 parts by mass and 50 parts by mass respectively, these charge control fine particles will be called [EA-CCA7-10] and [EA-CCA7-50] respectively.

Spherical silica whose primary particle size was 110 nm and whose surface with 28 $m^2/g$ in BET specific surface area was hydrophobized by HMDS (hexamethyldisilazane) was further added to each of these EA-CCA7, whereby the charge control agent compositions for external addition of the present invention were manufactured, in which the sum of surface areas of 10 mg mixture of these were 0.4 $m^2$, 0.7 $m^2$, and 1.1 $m^2$ (corresponding to 40 $m^2/g$, 70 $m^2/g$, and 110 $m^2/g$ specific surface areas respectively).

Regarding the obtained charge control agent compositions for external addition, those in which [EA-CCA7-10] was used and the sum of the surface areas of the carrier particles was 0.4 $m^2$, 0.7 $m^2$, and 1.1 $m^2$ were named examples 7-1, 7-2, and 7-3 respectively in the order mentioned, and those in which [EA-CCA7-50] was used and the sum of the surface areas of the carrier particles was 0.4 $m^2$, 0.7 $m^2$, and 1.1 $m^2$ were named examples 7-4, 7-5, and 7-6 respectively in the order mentioned.

Example 8

THF (tetrahydrofuran) was fed into a kneader and while stirring, silica whose primary particles had 12 nm in average particle size with 140 $m^2/g$ in BET specific surface area was hydrophobized by HMDS (hexamethyldisilazane) was added, followed by mixing. Next, while this mixture was being kneaded, 1 mass % styrene acrylate resin of THF used for a toner was dropped and mixed. Further, the negative chargeable-type CCA1 used in the example 1 was fed and the CCA1 was completely dissolved in the THF present in the system, followed by further kneading for the purpose of uniformity. Thereafter, the THF was evaporated and sufficiently dried drying, whereby charge control fine particles (EA-CCA3) in which the CCA1 was deposited together with the styrene acrylate resin on a surface of the silica were obtained. Due to the drying, the EA-CCA3 was aggregated, but could be disintegrated by pulverizing and classification by an IDS-2 pulverizer and a DSX-2 classifier manufactured by Nippon Pneumatic Mfg. Co., Ltd.

The operations so far conform to those of the example 3, and since a ratio of the carrier particles, the styrene acrylate resin, and the CCA1 as components mixed at this time was set to 100/10/10 (parts by mass) and 100/10/50 (parts by mass), these charge control fine particles will be called [EA-CCA3-10] and [EA-CCA3-50] respectively, as in the example 3.

Next, THF (tetrahydrofuran) was fed into the kneader and while stirring, silica whose primary particles had 110 nm in average particle size and with 28 $m^2/g$ in BET specific surface area was hydrophobized by HMDS (hexamethyldisilazane) was added, followed by mixing. Next, while this mixture was being kneaded, 1 mass % styrene acrylate resin of THF used for a toner was dropped and mixed. Further, the negative chargeable-type CCA1 used in the example 1 was fed and the CCA1 was completely dissolved in the THF present in the system, followed by further kneading for the purpose of uniformity. Thereafter, the THF was evaporated and sufficiently dried whereby charge control fine particles (EA-CCA8) in which the CCA1 was deposited together with the styrene acrylate resin on a surface of the silica were obtained. Due to the drying, the EA-CCA8 was aggregated, but could be disintegrated by pulverizing and classification by an IDS-2 pulverizer and a DSX-2 classifier manufactured by Nippon Pneumatic Mfg. Co., Ltd. Since a ratio of the carrier particles, the styrene acrylate resin, and the CCA1 as components mixed at this time was set to 100/10/10 (parts by mass) and 100/10/50 (parts by mass), these charge control fine particles will be called [EA-CCA8-10] and [EA-CCA8-50] respectively.

Further, the charge control agent compositions for external addition of the present invention in which the sum of surface areas of 10 mg mixture of the EA-CCA3 and the EA-CCA8 was 0.4 $m^2$, 0.7 $m^2$, and 1.1 $m^2$ (corresponding to 40 $m^2/g$, 70 $m^2/g$, and 110 $m^2/g$ specific surface areas respectively) were manufactured.

Regarding the obtained charge control agent compositions for external addition, those in which [EA-CCA3-10] and [EA-CCA8-10] were used and the sum of the surface areas of the carrier particles was 0.4 $m^2$, 0.7 $m^2$, and 1.1 $m^2$ were named examples 8-1, 8-2, and 8-3 respectively in the order mentioned, and those in which [EA-CCA3-50] and [EA-CCA8-10] were used and the sum of the surface areas of the carrier particles was 0.4 $m^2$, 0.7 $m^2$, and 1.1 $m^2$ were named examples 8-4, 8-5, and 8-6 respectively in the order mentioned.

Further, those in which [EA-CCA3-10] and [EA-CCA8-50] were used and the sum of the surface areas of the carrier particles was 0.4 $m^2$, 0.7 $m^2$, and 1.1 $m^2$ were named examples 8-7, 8-8, and 8-9 respectively in the order mentioned, and those in which [EA-CCA3-50] and [EA-CCA8-50] were used and the sum of the surface areas of the carrier particles was 0.4 $m^2$, 0.7 $m^2$, and 1.1 $m^2$ were named examples 8-10, 8-11, and 8-12 respectively in the order mentioned.

Example 9

THF (tetrahydrofuran) was fed into a kneader and while stirring, silica whose primary particles had 12 nm in average particle size and with 140 $m^2$/g in BET specific surface area was hydrophobized by HMDS (hexamethyldisilazane) was added, followed by mixing. Next, while this mixture was being kneaded, 1 mass % styrene acrylate resin of THF used for a toner was dropped and mixed. Further, the negative chargeable-type CCA1 used in the example 1 was fed and the CCA1 was completely dissolved in the THF present in the system, followed by further kneading for the purpose of uniformity. Thereafter, the THF was evaporated and sufficiently dried, whereby charge control fine particles (EA-CCA3) in which the CCA1 was deposited together with the styrene acrylate resin on surface of the silica were obtained. Due to the drying, the EA-CCA3 was aggregated, but could be disintegrated by pulverizing and classification by an IDS-2 pulverizer and a DSX-2 classifier manufactured by Nippon Pneumatic Mfg. Co., Ltd.

The operations so far conform to those of the example 3, and since a ratio of the carrier particles, the styrene acrylate resin, and the CCA1 as components mixed at this time was set to 100/10/10 (parts by mass) and 100/10/50 (parts by mass), these charge control fine particles will be called [EA-CCA3-10] and [EA-CCA3-50] respectively, as in the example 3.

Next, THF (tetrahydrofuran) was fed into the kneader and while stirring, rutile-type titania whose primary particles had 15 nm in average particle size and with 70 $m^2$/g in BET specific surface area was hydrophobized by HMDS (hexamethyldisilazane) was added, followed by mixing. Next, while this mixture was being kneaded, 1 mass % styrene acrylate resin of THF used for toner was dropped and mixed. Further, the negative chargeable-type CCA1 used in the example 1 was fed and the CCA1 was completely dissolved in the THF present in the system, followed by further kneading for the purpose of uniformity. Thereafter, the THF was evaporated and sufficient dried, whereby charge control fine particles (EA-CCA9) in which the CCA1 was deposited together with the styrene acrylate resin on surface of the silica were obtained. Due to the drying, the EA-CCA9 was aggregated, but could be disintegrated by pulverized and classification by an IDS-2 pulverizer and a DSX-2 classifier manufactured by Nippon Pneumatic Mfg. Co., Ltd. Since a ratio of the carrier particles, the styrene acrylate resin, and the CCA1 as components mixed at this time was set to 100/10/10 (parts by mass) and 100/10/50 (parts by mass), these charge control fine particles will be called [EA-CCA9-10] and [EA-CCA9-50] respectively.

Further, the charge control agent compositions for external addition of the present invention in which the sum of surface areas of 10 mg mixture of the EA-CCA3 and the EA-CCA9 was 0.8 $m^2$, 1.0 $m^2$, and 1.2 $m^2$ (corresponding to 80 $m^2$/g, 100 $m^2$/g, and 130 $m^2$/g specific surface areas respectively) were manufactured.

Regarding the obtained charge control agent compositions for external addition, those in which [EA-CCA3-10] and [EA-CCA9-10] were used and the sum of the surface areas of the carrier particles was 0.8 $m^2$, 1.0 $m^2$, and 1.2 $m^2$ were named examples 9-1, 9-2, and 9-3 respectively in the order mentioned, and those in which [EA-CCA3-50] and [EA-CCA9-10] were used and the sum of the surface areas of the carrier particles was 0.8 $m^2$, 1.0 $m^2$, and 1.2 $m^2$ were named examples 9-4, 9-5, and 9-6 respectively in the order mentioned.

Further, those in which [EA-CCA3-10] and [EA-CCA9-50] were used and the sum of the surface areas of the carrier particles was 0.8 $m^2$, 1.0 $m^2$, and 1.2 $m^2$ were named examples 9-7, 9-8, and 9-9 respectively in the order mentioned, and those in which [EA-CCA3-50] and [EA-CCA9-50] were used and the sum of the surface areas of the carrier particles was 0.8 $m^2$, 1.0 $m^2$, and 1.2 $m^2$ were named examples 9-10, 9-11, and 9-12 respectively in the order mentioned.

[Preparation of Samples for Charge Amount Measurement]

19 g of standard carrier L (distributed by the Imaging Society of Japan) and 1 g of model toner particles with 8.2 μm in average particle size obtained by pulverizing and classification of styrene acrylate resin, were weighed out into a 100 mL polyethylene bottle. Further, 0.01 g of each of the charge control agent compositions for external addition manufactured in the examples from 1 to 9 was weighed out into the 100 mL polyethylene bottle. Samples thus prepared were adjusted in moisture and mixed according to toner charge amount measurement criteria (Journal of the Imaging Society of Japan, 37, 461 (1998)) of the Standard of the Imaging Society of Japan, and toner charge amount was measured, with the mixing time being varied. A paint conditioner (manufactured by Toyo Seiki-Seisakusho, Ltd.) was used for the mixing, and a blow-off charge amount measuring apparatus (manufactured by Toshiba Chemical Corporation, trade name: TB203) was used for measuring the toner charge amount. The moisture adjustment and the measurement were conducted under 23±3° C. temperature and 55±10% relative humidity (N/N environment).

Next, samples for blow-off were manufactured with the same compositions as those of the examples 2-6, 4-6, 6-6 and were adjusted in moisture for 24 hours in a 32° C. 80% RH environment (H/H environment), and the measurement was carried out. The results are shown in Table 1 as examples 2-6 (H/H), 4-6 (H/H), and 6-6 (H/H). As absolute values of the charge amount, 90% or more of values obtained when they were in the N/N environment were maintained, from which it has been seen that there is an extremely high effect of controlling the charge amount.

Comparative Examples 1 to 2

19 g of standard carrier #N-02 (distributed by the Imaging Society of Japan) and 1 g of model toner particles with 8.2 μm in average particle size obtained by pulverizing and classification of styrene acrylate resin, were weighed out into a 100 mL polyethylene bottle. Further, 0.001 g of each of the CCA1 and the CCA2 was directly weighed out into the 100 mL polyethylene bottle. These are comparative examples 1, 2. In the same manner as above, they were adjusted in moisture and mixed according to the toner charge amount measurement criteria (Journal of the Imaging Society of Japan, 37, 461

(1998)) of the Standard of the Imaging Society of Japan, and a toner electrification amount was measured, with the mixing time being varied.

Comparative Examples 3 to 4

19 g of standard carrier #N-02 (distributed by the Imaging Society of Japan) and 1 g of model toner particles with 8.2 μm in average particle size obtained by pulverizing and classification of styrene acrylate resin, were weighed out into a 100 mL polyethylene bottle. Further, 5 mg of the EA-CCA1-10 and 5 mg of the hydrophobic silica which was used in the EA-CCA1-10 and which had the 140 $m^2/g$ in BET specific surface area and had the primary particles with 12 nm in average particle size were added into a 100 mL polyethylene bottle, and this is a comparative example 3.

19 g of standard carrier #N-02 (distributed by the Imaging Society of Japan) and 1 g of model toner particles with 8.2 μm in average particle size obtained by pulverising and classification of styrene acrylate resin, were weighed out into a 100 mL polyethylene bottle. 5 mg of the EA-CCA5-10 and 5 mg of the hydrophobic silica which was used in the EA-CCA5-10 and which had the 28 $m^2/g$ in BET specific surface area and had the primary particles with 110 nm in average particle size were added into a 100 mL polyethylene bottle, and this is a comparative example 4.

In the comparative example 3, charge amount increased with the mixing time, and a sufficient effect of charge control could not be obtained. Further, in the example 4, a sufficient charge amount could not be obtained.

As toner charge amount in the examples from 1 to 9 and the comparative examples from 1 to 4 described above, a four-minute mixture value and a 32-minute mixture value which are the results of the blow-off charge amount measurement are shown in Table 1.

TABLE 1

| | contained charge control fine particles | surface area of 10 mg charge control particles for external addition ($m^2$) | CCA amount per surface area of carrier particles ($mg/m^2$) | CCA amount per 100 parts by mass of toner (part by mass) | mass ratio of large particles/small particles | blow-off charge amount 4-minute mixture value (μC/g) | blow-off charge amount 32-minute mixture value (μC/g) |
|---|---|---|---|---|---|---|---|
| Example 1-1 | EA-CCA1-10 | 0.4 | 0.255 | 0.011 | 89/11 | −35.1 | −40.2 |
| Example 1-2 | | 0.7 | 0.543 | 0.038 | 63/37 | −32.2 | −33.8 |
| Example 1-3 | | 1.1 | 0.666 | 0.073 | 25/75 | −30.3 | −33.3 |
| Example 1-4 | EA-CCA1-50 | 0.4 | 1.275 | 0.055 | 89/11 | −40.2 | −44.3 |
| Example 1-5 | | 0.7 | 2.715 | 0.190 | 63/37 | −39.6 | −41.1 |
| Example 1-6 | | 1.1 | 3.330 | 0.365 | 25/75 | −38.6 | −40.0 |
| Example 2-1 | EA-CCA2-1 | 0.4 | 0.025 | 0.001 | 89/11 | −25.6 | −24.4 |
| Example 2-2 | | 0.7 | 0.054 | 0.004 | 63/37 | −22.2 | −23.6 |
| Example 2-3 | | 1.1 | 0.067 | 0.007 | 25/75 | −21.9 | −22.1 |
| Example 2-4 | EA-CCA2-5 | 0.4 | 0.128 | 0.005 | 89/11 | −25.1 | −25.0 |
| Example 2-5 | | 0.7 | 0.272 | 0.019 | 63/37 | −23.6 | −24.0 |
| Example 2-6 | | 1.1 | 0.333 | 0.037 | 25/75 | −23.0 | −23.4 |
| Example 3-1 | EA-CCA3-10 | 0.4 | 0.255 | 0.011 | 89/11 | −34.9 | −39.9 |
| Example 3-2 | | 0.7 | 0.543 | 0.038 | 63/37 | −33.2 | −34.9 |
| Example 3-3 | | 1.1 | 0.666 | 0.073 | 25/75 | −32.7 | −33.3 |
| Example 3-4 | EA-CCA3-50 | 0.4 | 1.275 | 0.055 | 89/11 | −40.0 | −42.1 |
| Example 3-5 | | 0.7 | 2.715 | 0.190 | 63/37 | −39.5 | −41.0 |
| Example 3-6 | | 1.1 | 3.330 | 0.365 | 25/75 | −38.2 | −37.6 |
| Example 4-1 | EA-CCA4-1 | 0.4 | 0.025 | 0.001 | 89/11 | −24.4 | −24.1 |
| Example 4-2 | | 0.7 | 0.054 | 0.004 | 63/37 | −22.8 | −26.6 |
| Example 4-3 | | 1.1 | 0.067 | 0.007 | 25/75 | −21.7 | −23.1 |
| Example 4-4 | EA-CCA4-5 | 0.4 | 0.128 | 0.005 | 89/11 | −22.1 | −25.4 |
| Example 4-5 | | 0.7 | 0.272 | 0.019 | 63/37 | −23.0 | −24.0 |
| Example 4-6 | | 1.1 | 0.333 | 0.037 | 25/75 | −23.0 | −23.8 |

TABLE 2

| | contained charge control fine particles | surface area of 10 mg charge control particles for external addition ($m^2$) | CCA amount per surface area of carrier particles ($mg/m^2$) | CCA amount per 100 parts by mass of toner (part by mass) | mass ratio of large particles/small particles | blow-off charge amount 4-minute mixture value (μC/g) | blow-off charge amount 32-minute mixture value (μC/g) |
|---|---|---|---|---|---|---|---|
| Example 5-1 | EA-CCA5-10 | 0.35 | 0.171 | 0.006 | 94/6 | −32.1 | −36.2 |
| Example 5-2 | | 0.56 | 0.446 | 0.025 | 75/25 | −30.2 | −33.0 |
| Example 5-3 | | 0.84 | 0.595 | 0.050 | 50/50 | −29.8 | −30.3 |
| Example 5-4 | EA-CCA5-50 | 0.35 | 0.171 | 0.030 | 94/6 | −35.1 | −39.3 |
| Example 5-5 | | 0.56 | 0.446 | 0.125 | 75/25 | −34.6 | −38.0 |
| Example 5-6 | | 0.84 | 0.595 | 0.250 | 50/50 | −33.6 | −36.8 |
| Example 6-1 | EA-CCA6-1 | 0.35 | 0.171 | 0.0006 | 94/6 | −23.6 | −24.4 |
| Example 6-2 | | 0.56 | 0.446 | 0.003 | 75/25 | −22.0 | −23.8 |
| Example 6-3 | | 0.84 | 0.595 | 0.005 | 50/50 | −21.8 | −22.6 |
| Example 6-4 | EA-CCA6-5 | 0.35 | 0.171 | 0.003 | 94/6 | −24.1 | −25.0 |
| Example 6-5 | | 0.56 | 0.446 | 0.013 | 75/25 | −23.6 | −24.1 |
| Example 6-6 | | 0.84 | 0.595 | 0.025 | 50/50 | −23.0 | −23.6 |
| Example 7-1 | EA-CCA7-10 | 0.4 | 0.255 | 0.011 | 89/11 | +35.5 | +40.6 |
| Example 7-2 | | 0.7 | 0.543 | 0.038 | 63/37 | +32.8 | +34.8 |

TABLE 2-continued

| | contained charge control fine particles | surface area of 10 mg charge control particles for external addition ($m^2$) | CCA amount per surface area of carrier particles ($mg/m^2$) | CCA amount per 100 parts by mass of toner (part by mass) | mass ratio of large particles/small particles | blow-off charge amount 4-minute mixture value (μC/g) | blow-off charge amount 32-minute mixture value (μC/g) |
|---|---|---|---|---|---|---|---|
| Example 7-3 | | 1.1 | 0.666 | 0.073 | 25/75 | +30.9 | +35.0 |
| Example 7-4 | EA-CCA7-50 | 0.4 | 1.275 | 0.055 | 89/11 | +40.7 | +44.5 |
| Example 7-5 | | 0.7 | 2.715 | 0.190 | 63/37 | +40.6 | +41.6 |
| Example 7-6 | | 1.1 | 3.330 | 0.365 | 25/75 | +38.9 | +41.0 |
| Example 8-1 | EA-CCA3-10 + | 0.4 | 2.500 | 0.100 | 89/11 | −35.0 | −40.0 |
| Example 8-2 | EA-CCA8-10 | 0.7 | 1.420 | 0.100 | 63/37 | −33.8 | −34.8 |
| Example 8-3 | | 1.1 | 0.909 | 0.100 | 25/75 | −32.3 | −34.1 |
| Example 8-4 | EA-CCA3-50 + | 0.4 | 11.43 | 0.457 | 89/11 | −41.2 | −44.0 |
| Example 8-5 | EA-CCA8-10 | 0.7 | 3.571 | 0.250 | 63/37 | −39.0 | −40.1 |
| Example 8-6 | | 1.1 | 3.636 | 0.400 | 25/75 | −38.6 | −40.0 |

TABLE 3

| | contained charge control fine particles | surface area of 10 mg charge control particles for external addition ($m^2$) | CCA amount per surface area of carrier particles ($mg/m^2$) | CCA amount per 100 parts by mass of toner (part by mass) | mass ratio of large particles/small particles | blow-off charge amount 4-minute mixture value (μC/g) | blow-off charge amount 32-minute mixture value (μC/g) |
|---|---|---|---|---|---|---|---|
| Example 8-7 | EA-CCA3-10 + | 0.4 | 3.570 | 0.143 | 89/11 | −35.1 | −40.2 |
| Example 8-8 | EA-CCA8-50 | 0.7 | 5.000 | 0.350 | 63/37 | −38.2 | −36.8 |
| Example 8-9 | | 1.1 | 1.818 | 0.200 | 25/75 | −38.3 | −39.3 |
| Example 8-10 | EA-CCA3-50 + | 0.4 | 12.50 | 0.500 | 89/11 | −41.2 | −43.3 |
| Example 8-11 | EA-CCA8-50 | 0.7 | 7.143 | 0.500 | 63/37 | −42.1 | −43.1 |
| Example 8-12 | | 1.1 | 4.545 | 0.500 | 25/75 | −44.6 | −44.0 |
| Example 9-1 | EA-CCA3-10 + | 0.8 | 1.250 | 0.100 | 86/14 | −30.0 | −31.0 |
| Example 9-2 | EA-CCA9-10 | 1.0 | 1.000 | 0.100 | 57/43 | −31.8 | −32.8 |
| Example 9-3 | | 1.2 | 0.833 | 0.100 | 29/71 | −30.3 | −31.1 |
| Example 9-4 | EA-CCA3-50 + | 0.8 | 1.965 | 0.157 | 86/14 | −38.2 | −39.0 |
| Example 9-5 | EA-CCA9-10 | 1.0 | 2.716 | 0.272 | 57/43 | −38.0 | −39.1 |
| Example 9-6 | | 1.2 | 3.856 | 0.386 | 29/71 | −38.6 | −39.0 |
| Example 9-7 | EA-CCA3-10 + | 0.8 | 5.535 | 0.443 | 86/14 | −35.7 | −38.2 |
| Example 9-8 | EA-CCA9-50 | 1.0 | 3.284 | 0.328 | 57/43 | −38.0 | −37.8 |
| Example 9-9 | | 1.2 | 1.787 | 0.214 | 29/71 | −38.3 | −39.3 |
| Example 9-10 | EA-CCA3-50 + | 0.8 | 6.250 | 0.500 | 86/14 | −40.0 | −40.3 |
| Example 9-11 | EA-CCA9-50 | 1.0 | 5.000 | 0.500 | 57/43 | −41.1 | −41.7 |
| Example 9-12 | | 1.2 | 4.167 | 0.500 | 29/71 | −41.6 | −42.0 |
| Example 2-6 (H/H) | EA-CCA2-5 | 1.1 | 0.333 | 0.037 | 25/75 | −21.8 | −22.0 |
| Example 4-6 (H/H) | EA-CCA4-5 | 1.1 | 0.333 | 0.037 | 25/75 | −21.0 | −21.5 |
| Example 6-6 (H/H) | EA-CCA6-5 | 0.84 | 0.595 | 0.025 | 50/50 | −22.0 | −21.7 |

TABLE 4

| | contained charge control fine particles | CCA amount per surface area of carrier particles ($mg/m^2$) | CCA amount per 100 parts by mass of toner (parts by mass) | blow-off charge amount 4-minute mixture value (μC/g) | blow-off charge amount 32-minute mixture value (μC/g) |
|---|---|---|---|---|---|
| Comparative Example 1 | CCA1 | — | 0.100 | −20.6 | −22.3 |
| Comparative Example 2 | CCA2 | — | 0.100 | −15.6 | −16.6 |
| Comparative Example 3 | EA-CCA1 | 0.714 | 0.050 | −35.5 | −58.6 |
| Comparative Example 4 | EA-CCA5 | 1.786 | 0.050 | −13.3 | −14.0 |

Example 10

Among the charge control fine particles prepared in the examples from 1 to 9 (EA-CCA), 0.5 parts by mass of each of the EA-CCA2-5, EA-CCA3-50, EA-CCA5-50, EA-CCA6-5, and EA-CCA7-50 was externally added per 100 parts by mass of toner particles which were obtained by melting and kneading 100 parts by mass of polyester resin for toner, 4 parts by mass of carbon black, and 3 parts by mass of an ester-based wax and which was adjusted to 7.2 μm after pulverizing and classification. Further, 1.5 parts by mass of silica having primary particles with 20 nm in average particle size and hydrophobized by HMDS was added, whereby electrostatic image developing toners were fabricated.

They will be called examples code as 10-1, 10-2, 10-3, 10-4 and 10-5. When these toners were each supplied to a printer (manufactured by Ricoh Co., Ltd., trade name: IPSIO SP6110), image quality not different from initial image quality was maintained even after 30000-sheet printing, and there was no contamination of the inside of the printer due to the scattering of the toner.

Comparative Example 5

4 parts by mass of carbon black, 3 parts by mass of an ester-based wax, and 1 part by mass of the CCA2 were melted and kneaded per 100 parts by mass of polyester resin for toner, and toner particles adjusted to 7.2 μm after pulverizing and classification was fabricated. 1.5 parts by mass of silica having primary particles with 20 nm in average particle size and hydrophobized by HMDS was added to the obtained toner particles, whereby electrostatic image developing toners were fabricated (comparative example 5). When these electrostatic image developing toners were each supplied to a printer (manufactured by Ricoh Co., Ltd., trade name: IPSIO SP6110), blurring or ground fogging occurred in characters and solid images before 3000-sheet printing, and it was not possible to maintain initial image quality.

As described above, the charge control agent composition for external addition of the present invention is capable of stably imparting a substantially constant charge amount even when its addition amount or mixture time is changed or even when a CCA amount to the toner particles greatly changes. Further, since two types of the carrier particles different in primary particle size were used, initial image quality was maintained and durability was good even after the 3000-sheet printing. Furthermore, it has been confirmed that the electrostatic image developing toner using this charge control agent composition for external addition is less likely to cause deterioration of image quality at the time of continuous printing, and it has been found out that an electrostatic image developing toner excellent in printing property can be provided.

Next, examples (examples 11 to 14) corresponding to the second embodiment and comparative examples (comparative examples 6 to 7) will be described.

Example 11

A zinc complex of tertiary-butylsalicylic acid being a negative chargeable-type CCA (manufactured by Orient Chemical Industry Co., Ltd., trade name: BONTRON E-304) was pulverized by a pulverizer IDS-2 type manufactured by Nippon Pneumatic Mfg. Co., Ltd. The pulverized powder was collected by a cyclone and powder on bag filter was also collected. An average particle size which was measured by a laser diffraction particle size distribution measuring apparatus (manufactured by Nikkiso Co., Ltd., trade name: Microtrac), with water for dispersing solvent, was 550 nm in D50. This will be named CCA11.

100 parts by mass of polyester resin for toner, 4 parts by mass of carbon black, and 3 parts by mass of an ester-based wax were melted and kneaded, and toner particles adjusted to 7.2 μm after pulverized and classification was fabricated. To 2000 g of the toner particles, 16 g of spherical silica (0.8 parts by mass per 100 parts by mass of the toner particles) which had primary particles with 110 nm in average particle size and with 28 $m^2/g$ in BET specific surface area was hydrophobized by HMDS (hexamethyldisilazane), 4 g of the aforesaid CCA 11 (25 parts by mass per 100 parts by mass of the spherical silica, 0.2 parts by mass per 100 parts by mass of the toner particles), and 40 g of silica (2 parts by mass per 100 parts by mass of the toner particles) which had primary particles with 12 nm in average particle size and with 140 $m^2/g$ in BET specific surface was hydrophobized by HMDS (hexamethyldisilazane) were simultaneously added, and the resultant was mixed for two minutes at 2600 rpm by using a 20 L powder mixer and further made to pass through a 200-mesh sieve, whereby an electrostatic image developing toner 11 was obtained.

19 g of standard carrier N-01 (distributed by the Imaging Society of Japan) was weighed out into a 100 mL polyethylene bottle. Further, 1 g of the fabricated electrostatic image developing toner 11 was weighed out into the 100 mL polyethylene bottle. A sample thus prepared was adjusted in moisture and mixed according to the toner charge amount measurement method (Journal of the Imaging Society of Japan, 37, 461 (1998)) of the Standard of the Imaging Society of Japan, and a toner charge amount was measured, with the mixing time being varied. A paint conditioner (manufactured by Toyo Seiki-Seisakusho, Ltd.) was used for the mixing, and a blow-off charge amount measuring apparatus (manufactured by Toshiba Chemical Corporation, trade name: TB203) was used for measuring the toner charge amount. The charge amount was −35 μC/g after the two-minute mixture and −36 μC/g after the eight-minute mixture.

Further, when this electrostatic image developing toner 11 was supplied to a printer (manufactured by Ricoh Co., Ltd., trade name: IPSIO SP6110), image quality not different from initial image quality was maintained even after 30000-sheet printing, and there was no contamination of the inside of the printer due to the scattering of the toner.

Example 12

An azo complex (manufactured by Hodogaya Chemical Co., Ltd., trade name: T-77) being a negative electrification-type CCA whose center metal was iron was ground by a pulverizer IDS-2 type manufactured by Nippon Pneumatic Mfg. Co., Ltd. The pulverized powder was collected by a cyclone collection and powder on bag filter was also collected. An average particle size which was measured by a laser diffraction particle size distribution measuring apparatus (manufactured by Nikkiso Co., Ltd., trade name: Microtrac), with water for dispersing solvent, was 800 nm in D50. This will be named CCA12.

100 parts by mass of polyester resin for toner, 4 parts by mass of carbon black, and 3 parts by mass of an ester-based wax were melted and kneaded, and toner particles adjusted to 7.2 μm after pulverizing and classification was fabricated. To 2000 g of the toner particles, 16 g spherical silica (0.8 parts by mass per 100 parts by mass of the toner particles) which had primary particles with 110 nm in average particle size and with 28 $m^2/g$ in BET specific surface area was hydrophobized by HMDS (hexamethyldisilazane), 4 g of the aforesaid CCA 12 (25 parts by mass per 100 parts by mass of the spherical silica, 0.2 parts by mass per 100 parts by mass of the toner particles), and 40 g of silica (2 parts by mass per 100 parts by mass of the toner particles) which had primary particles with 12 nm in average particle size and with 140 $m^2/g$ in BET specific surface area was hydrophobized by HMDS (hexamethyldisilazane) were simultaneously added, and the resultant was mixed for two minutes at 2600 rpm by using a 20 L powder mixer and further made to pass through a 200-mesh sieve, whereby an electrostatic image developing toner 12 was obtained.

When, regarding this electrostatic image developing toner 12, charge amount was measured by the same method as that of the example 11, it was −40 μC/g after the two-minute mixture and −42 μC/g after the eight-minute mixture.

Further, when this electrostatic image developing toner 12 was supplied to a printer (manufactured by Ricoh Co., Ltd., trade name: IPSIO SP6110), image quality not different from initial image quality was maintained even after 30000-sheet printing, and there was no contamination of the inside of the printer due to the scattering of the toner.

Example 13

A boron complex (manufactured by Nippon Carlit Co., Ltd., trade name: LR-147) being a negative electrification-type CCA was ground by a pulverizer IDS-2 type manufactured by Nippon Pneumatic Mfg. Co., Ltd. The pulverized powder was collected by a cyclone collection and powder on bag filter was also collected. An average particle size which was measured by a laser diffraction particle size distribution measuring apparatus (manufactured by Nikkiso Co., Ltd., trade name: Microtrac), with water being a dispersion solvent, was 650 nm in D50. This will be named CCA13.

100 parts by mass of polyester resin for toner, 4 parts by mass of carbon black, and 3 parts by mass of an ester-based wax were melted and kneaded, and toner particles adjusted to 7.2 μm after grinding and classification was fabricated. To 2000 g of the toner particles, 19 g of spherical silica (1.9 parts by mass per 100 parts by mass of the toner particles) which had primary particles with 110 nm in average particle size and with 28 $m^2/g$ in BET specific surface area was hydrophobized by HMDS (hexamethyldisilazane), 1 g of the CCA 13 (5.26 parts by mass per 100 parts by mass of the spherical silica, 0.05 parts by mass per 100 parts by mass of the toner particles), and 40 g of silica (2 parts by mass per 100 parts by mass of the toner particles) which had primary particles with 12 nm in average particle size and with 140 $m^2/g$ in BET specific surface area was hydrophobized by HMDS (hexamethyldisilazane) were simultaneously added, and the resultant was mixed for two minutes at 2600 rpm by using a 20 L powder mixer and further made to pass through a 200-mesh sieve, whereby an electrostatic image developing toner 13 was obtained.

When, regarding this electrostatic image developing toner 13, charge amount was measured by the same method as that of the example 11, it was −25 μC/g after the two-minute mixture and −26 μC/g after the eight-minute mixture. Further, charge amount after the electrostatic image developing toner 13 fabricated by the same method was left standing for 24 hours in a 32° C. 75% RH environment was −22 μC/g after the two-minute mixture and −23 μC/g after the eight-minute mixture and thus was very stable.

Further, when this electrostatic image developing toner 13 was supplied to a printer (manufactured by Ricoh Co., Ltd., trade name: IPSIO SP6110), image quality not different from initial image quality was maintained even after 30000-sheet printing, and there was no contamination of the inside of the printer due to the scattering of the toner.

Example 14

A nigrosine dye (manufactured by Chuo Synthetic Chemical Co., Ltd., trade name: CHUO CCA3) being a positive chargeable-type CCA was ground by a pulverizer IDS-2 type manufactured by Nippon Pneumatic Mfg. Co., Ltd. The pulverized powder was collected by a cyclone and powder on bag filter was also collected. An average particle size which was measured by a laser diffraction particle size distribution measuring apparatus (manufactured by Nikkiso Co., Ltd., trade name: Microtrac), with water for dispersing solvent, was 330 nm in D50. This will be named CCA14.

100 parts by mass of polyester resin for toner, 4 parts by mass of carbon black, and 3 parts by mass of an ester-based wax were melted and kneaded, and toner particles adjusted to 7.2 μm after pulverizing and classification was fabricated. To 2000 g of the toner particles, 16 g of spherical silica (0.8 parts by mass per 100 parts by mass of the toner particles) which had primary particles with 110 nm in average particle size and with 28 $m^2/g$ in BET specific surface area was hydrophobized by HMDS (hexamethyldisilazane), 4 g of the aforesaid CCA 14 (25 parts by mass per 100 parts by mass of the spherical silica, 0.2 parts by mass per 100 parts by mass of the toner particles), and 40 g of silica (2 parts by mass per 100 parts by mass of the toner particles) which had primary particles with 12 nm in average particle size and with 140 $m^2/g$ in BET specific surface area was hydrophobized by an aminosilane-based silane coupling agent were simultaneously added, and the resultant was mixed for two minutes at 2600 rpm by using a 20 L powder mixer and further made to pass through a 200-mesh sieve, whereby an electrostatic image developing toner 14 was obtained.

When, regarding this electrostatic image developing toner 14, charge amount was measured by the same method as that of the example 11, it was +35 μC/g after the two-minute mixture and +33 μC/g after the eight-minute mixture. Further, charge amount after the electrostatic image developing toner 14 fabricated by the same method was left standing for 24 hours in a 32° C. 75% RH environment was +31 μC/g after the two-minute mixture and +32 μC/g after the eight-minute mixture and thus was very stable.

Further, when this electrostatic image developing toner 14 was supplied to a printer (manufactured by Brother Industry, Ltd., trade name: HL-5240), image quality not different from initial image quality was maintained even after 30000-sheet printing, and there was no contamination of the inside of the printer due to the scattering of the toner.

Comparative Examples 6, 7

4 parts by mass of carbon black, 3 parts by mass of an ester-based wax, and 1 part by mass of the CCA11 were melted and kneaded per 100 parts by mass of polyester resin for toner, and toner particles adjusted to 7.3 μm after pulverizing and classification was fabricated. 0.2 parts by mass of silica which had primary particles with 110 nm in average particle size and with 28 $m^2/g$ in BET specific surface area was hydrophobized by HMDS and 0.8 parts by mass of silica which had primary particles with 12 nm in average particle size and with 140 $m^2/g$ in BET specific surface area was hydrophobized by HMDS (hexamethyldisilazane) were simultaneously added per 100 parts by mass of the obtained toner particles, and the resultant was mixed by the same method as that of the example 11, whereby an electrostatic image developing toner C6 was fabricated (comparative example 6). Further, in the comparative example 6, 1 part by mass of the CCA12 was added instead of the CCA11, whereby an electrostatic image developing toner C7 was fabricated in the same manner (comparative example 7). When these electrostatic image developing toners were each supplied to a printer (manufactured by Ricoh Co., Ltd., trade name: IPSIO SP6110), blurring or ground fogging occurred in characters and solid images before 3000-sheet printing, and it was not possible to maintain initial image quality.

As described above, it is seen that, with the charge control agent composition of the present invention, the toner charge amount undergoes only a little change due to the mixing and is stable. Furthermore, it has been confirmed that the electrostatic image developing toner using this charge control agent composition for external addition is less likely to cause deterioration of image quality at the time of continuous printing, and it has been found out that an electrostatic image developing toner excellent in printing property can be provided.

What is claimed is:

1. A charge control agent composition comprising:

at least two types of carrier particles different in average particle size of primary particles;

a resin covering a surface of at least one type of the carrier particles; and a charge control agent (CCA) deposited on said surface of said at least one type of the carrier particles, wherein the charge control agent comprises an organic compound having an electron-accepting functional group or an electron-donating functional group, a salt of the organic compound, and/or a complex of the organic compound.

2. The charge control agent composition according to claim 1, wherein the at least two types of carrier particles comprise a mixture of at least one type of carrier particles having primary particles with 20 nm in average particle size or more and at least one type of carrier particles having primary particles with less than 20 nm in average particle size.

3. The charge control agent composition according to claim 2, wherein the carrier particles with 20 nm in average particle size or more have the charge control agent (CCA) in a range from 0.1 to 50 parts by mass per 100 parts by mass of the carrier particles, and/or the carrier particles with less than 20 nm in average particle size have the charge control agent (CCA) in a range from 1 to 500 parts by mass per 100 parts by mass of the carrier particles.

4. The charge control agent composition according to claim 2, wherein the charge control agent (CCA) contained in the carrier particles with 20 nm in average particle size or more and the charge control agent (CCA) contained in the carrier particles with less than 20 nm in average particle size are compounds that are substantially the same.

5. The charge control agent composition according to claim 2, wherein, when the resin covering the surface of the carrier particles covers the carrier particles having the primary particles with 20 nm in average particle size or more, an amount of the resin is from 2 to 200 parts by mass per 100 parts by mass of the carrier particles, and when the resin covers the carrier particles having the primary particles with less than 20 nm in average particle size, an amount of the resin is from 1 to 500 parts by mass per 100 parts by mass of the carrier particles.

6. The charge control agent composition according to claim 1, wherein an amount of the charge control agent (CCA) deposited on the surfaces of the carrier particles is from 1 to 2000 parts by mass per 100 parts by mass of the resin.

7. An electrostatic image developing toner comprising:

toner particles; and a charge control agent composition according to claim 1.

8. The electrostatic image developing toner according to claim 7, wherein totally from 0.01 to 5 parts by mass of the charge control agent composition is mixed per 100 parts by mass of the toner particles.

9. The electrostatic image developing toner according to claim 8, wherein a total amount of the charge control agent (CCA) contained in the charge control agent composition is $1\times10^{-5}$ to 1 part by mass per 100 parts by mass of the toner particles.

* * * * *